US006307533B1

(12) United States Patent
Nakamura et al.

(10) Patent No.: US 6,307,533 B1
(45) Date of Patent: Oct. 23, 2001

(54) LIQUID CRYSTAL DISPLAY DEVICE WITH MATRIX ELECTRODE STRUCTURE

(75) Inventors: Koji Nakamura, Tokai; Norifumi Souda, Kariya; Toshio Yamamoto, Toyoake, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/129,101

(22) Filed: Aug. 5, 1998

(30) Foreign Application Priority Data

Aug. 21, 1997 (JP) ..... 9-225182

(51) Int. Cl.[7] ..... G09G 3/36
(52) U.S. Cl. ..... 345/95; 345/97; 345/210
(58) Field of Search ..... 345/87, 94, 95, 345/96, 97, 98, 99, 208–210; 349/33, 34, 37

(56) References Cited

U.S. PATENT DOCUMENTS

| | | |
|---|---|---|
| 4,850,676 | 7/1989 | Yazaki et al. . |
| 5,418,634 | 5/1995 | Kanbe et al. . |
| 5,459,481 | 10/1995 | Tanaka et al. . |
| 5,506,601 | 4/1996 | Mihara et al. . |
| 5,731,795 | 3/1998 | Kanda et al. . |

FOREIGN PATENT DOCUMENTS

| | | |
|---|---|---|
| 3834791A1 | 4/1989 | (DE) . |
| 564 263 | 10/1993 | (EP) . |
| 613 116 | 8/1994 | (EP) . |
| 0768557A1 | 4/1997 | (EP) . |
| 0780825A1 | 6/1997 | (EP) . |
| 63-91634 | 4/1988 | (JP) . |
| 2-2510 | 1/1990 | (JP) . |
| 3-73925 | 3/1991 | (JP) . |
| 4-311920 | 4/1992 | (JP) . |
| 4-311920 | 11/1992 | (JP) . |
| 5-53091 | 3/1993 | (JP) . |
| 5-119746 | 5/1993 | (JP) . |
| 7-20441 | 1/1995 | (JP) . |
| 7-28432 | 1/1995 | (JP) . |
| 7-43676 | 2/1995 | (JP) . |
| 9-5708 | 1/1997 | (JP) . |

*Primary Examiner*—Regina Liang
(74) *Attorney, Agent, or Firm*—Pillsbury Winthrop LLP

(57) ABSTRACT

The present invention provides a liquid crystal display device having a matrix electrode structure in which an image elimination period for rewriting a display is shortened without sacrificing the display brightness, while suppressing flicker, a ghost image and a cross-talk on the display. In the eliminating period, a pulse voltage having a polarity opposite to that of a holding voltage imposed in an image holding period preceding the selecting period is applied to scanning electrodes, and then a lower level standard voltage is applied. The pulse voltage may be in a form of one or more bipolar pulses having a pair of pulses with opposite polarities. The eliminating period for rewriting the display is considerably shortened according to the present invention.

13 Claims, 25 Drawing Sheets

LIQUID CRYSTAL DISPLAY DEVICE WITH MATRIX ELECTRODE STRUCTURE

CROSS-REFERENCE TO RELATED APPLICATION

The present application is related to and claims priority from Japanese Patent Application No. Hei-9-225182, filed on Aug. 21, 1997, the content of which is incorporated herein by reference.

BACKGROUND OF THE INVENTION

1. Field of the Invention

The present invention generally relates to a liquid crystal display device, and more particularly to a liquid crystal display device which has a matrix electrode structure to drive n×m pixels.

2. Description of Related Art

JP-A-5-119746 discloses a liquid crystal display device with a matrix electrode structure. As the liquid crystal for the display, an anti-ferroelectric material is used. The anti-ferroelectric liquid crystal of this kind has at least one anti-ferroelectric state (a first stable state AF) and two ferroelectric states (second and third stable states F+, F−), and each of these states can be attained stably.

The liquid crystal display device disclosed in the above-mentioned publication displays picture images on the panel by sequentially scanning its scanning electrodes which constitute a matrix together with signal electrodes. A selection voltage for writing images in combination with a signal voltage supplied to the signal electrodes is sequentially supplied to the scanning electrodes, and then a holding voltage to maintain the written images is supplied to the scanning electrodes. The selection voltage is supplied to each scanning electrode with a predetermined phase shift. However, there are problems that the images may be displayed as ghost images and that moving images are difficult to be displayed in a good condition. This is because a response time for changing the state of the anti-ferroelectric liquid crystal from the ferroelectric state (F+ or F−) to the anti-ferroelectric state (AF) is more than 10 times longer than a response time for changing from AF to F+ or F−, and, accordingly, time required for switching images displayed becomes considerably long. In other words, displayed images are influenced by the optical response time of the anti-ferroelectric liquid crystal when they are eliminated, and, accordingly, the state of the liquid crystal immediately before application of the selecting voltage is different by pixel by pixel and luminance of each pixel may not be uniform even a same level of the selecting voltage is applied to pixels. This problem occurs not only in moving images but also in switching still images.

To solve the above-mentioned problem, some proposals have been made, for example, in JP-A-7-28432 and JP-A-7-43676. JP-A-7-28432 proposes to provide a response period to make the anti-ferroelectric liquid crystal change from the ferroelectric state to the anti-ferroelectric state in the selecting period. However, this driving method requires a longer time to scan one scanning electrode, because the selecting period is a total of both periods for writing images and for changing the state of the anti-ferroelectric liquid crystal from the ferro-electric state to the anti-ferroelectric state. Therefore, in the device having a large number of the scanning electrodes, moving images cannot be displayed properly. JP-A-7-43676 proposes to provide an eliminating period in which the anti-ferroelectric liquid crystal changes its states from the ferro-electric to the anti-ferroelectric between the selecting period and the holding period. This driving method enables to display the moving images in the device having a large number of scanning electrodes. However, because the level of the voltage applied in the eliminating period is zero, the response time from the ferroelectric state to the anti-ferroelectric state becomes longer, and, accordingly, the eliminating period has to be made longer. Therefore, there are such problems that the display luminance is low and that flicker appears when the display panel is driven by a low frequency. Also, in both driving methods disclosed in the above publications, the response of a particular pixel selected is influenced by image signals determining a display condition of other pixels to which the image signals are applied in an eliminating period before the selecting period for the particular pixel. This results in a phenomenon called a cross-talk in the longitudinal direction of the signal electrodes.

SUMMARY OF THE INVENTION

The present invention has been made in view of the above-mentioned problems, and an object of the present invention is to provide a liquid crystal display device using an anti-ferroelectric liquid crystal or a liquid crystal having a similar optical characteristic and having a matrix electrode structure, which has an improved driving system that attains a good display with a short eliminating period while suppressing the cross-talk.

A liquid crystal display panel is composed of a plurality of scanning electrodes, a plurality of signal electrodes and an anti-ferroelectric liquid crystal disposed between both electrodes. The signal electrodes are disposed perpendicularly to the scanning electrodes so that both electrodes form a matrix structure. Each intersection of both electrodes constitutes a pixel together with the anti-ferroelectric liquid crystal. Scanning voltages are sequentially supplied to the scanning electrodes from a scanning electrode driving circuit while signal voltages are sequentially supplied to the signal electrodes from a signal electrode driving circuit in synchronism with the scanning voltages. The scanning and signal voltages are combined on the pixels thereby displaying picture images on the display panel.

In a scanning process, selecting, holding and eliminating periods are provided in this order. The picture images are written on the pixels in the selecting period, maintained in the holding period and eliminated in the eliminating period. During the holding period the polarity of the holding voltage supplied from the scanning electrode driving circuit is reversed at least one time. Preferably, a refresh pulse voltage which is higher than the holding voltage is imposed on the scanning electrode at a time the polarity of the holding voltage is reversed, so that flicker of the display is suppressed even when the panel is driven with a relatively low frequency.

To eliminate the picture images maintained in the holding period as quickly as possible, a pulse voltage having a polarity opposite to that of the holding voltage is imposed on the scanning electrode at the beginning of the eliminating period, and then a standard voltage having a lower level than the pulse voltage is imposed. The anti-ferroelectric liquid crystal changes its state from a positive or negative ferro-electric state to an anti-ferroelectric state in the eliminating period, i.e., the picture images change from a bright state to a dark state. Then the next selecting period follows. By imposing the pulse voltage at the beginning of the selecting period, the picture images are quickly eliminated without sacrificing brightness of the display. The problems seen in conventional devices, such as the ghost image or the cross-talk, are avoided at the same time.

The level and width of the pulse voltage imposed in the eliminating period are chosen so that the picture images can be eliminated as quickly as possible. Preferably, the width of the pulse voltage is selected to be shorter than a response time of the anti-ferroelectric liquid crystal from the ferro-electric state to the anti-ferroelectric state. The pulse voltage may be imposed in a form of a bipolar pulse which is a pair of pulse consisting of a first pulse having a polarity opposite to the polarity of the preceding holding voltage and a second pulse having a reversed polarity. The level of the pulse voltage may be selected at the same as that of either the selecting or holding voltage. In this case, the number of voltage levels supplied from the power source does not have to be increased to supply the pulse voltage in the elimination period.

Other objects and features of the present invention will become more readily apparent from a better understanding of the preferred embodiments described below with reference to the following drawings.

DETAILED DESCRIPTION OF THE PREFERRED EMBODIMENTS

The preferred embodiments according to the present invention will be hereinafter described with reference to the accompanying drawings.

(First Embodiment)

Figure 1:
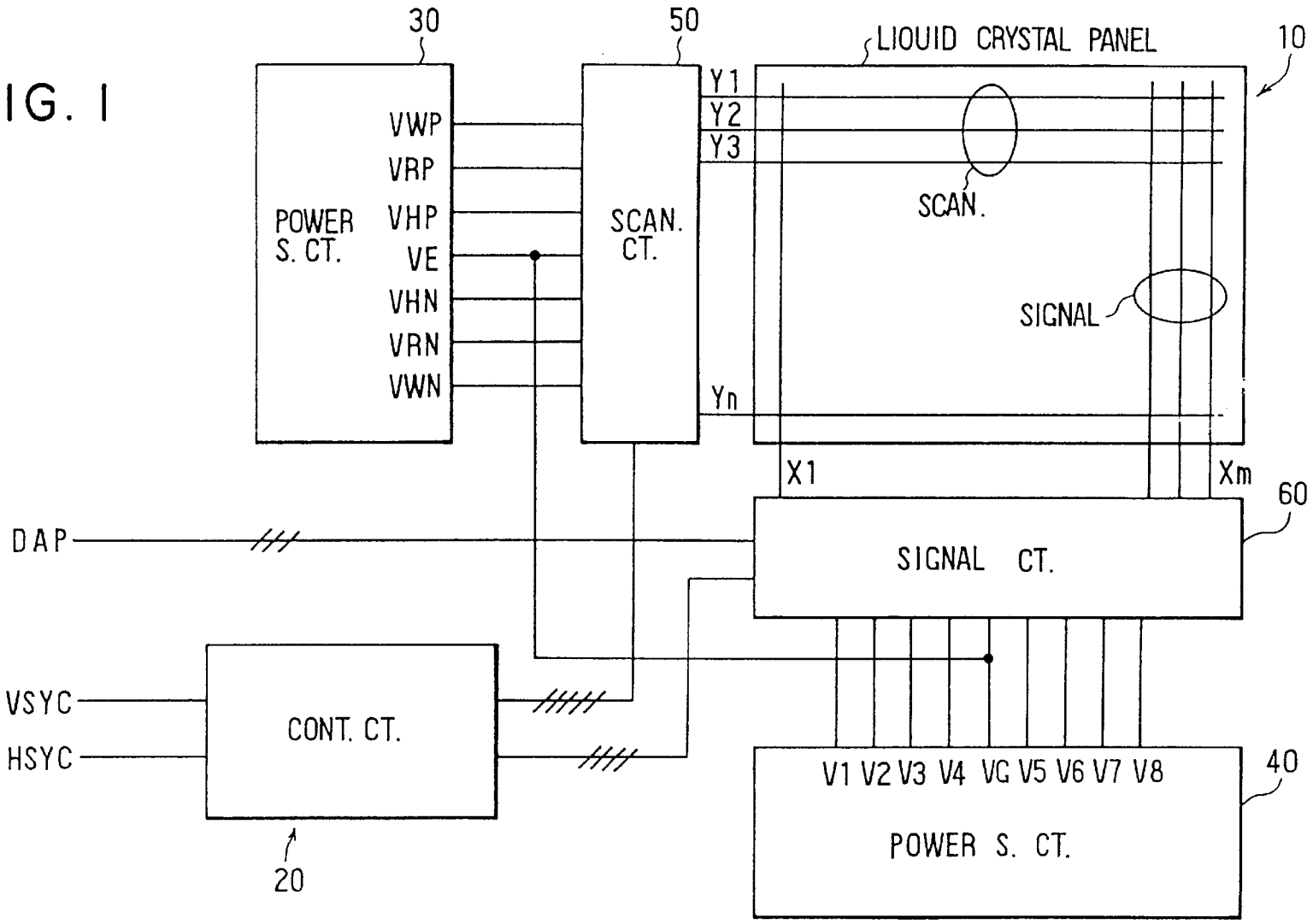
FIG. 1 is a whole structural diagram showing an embodiment of a liquid crystal display device with a matrix electrode structure according to the present invention.
Figure 2:
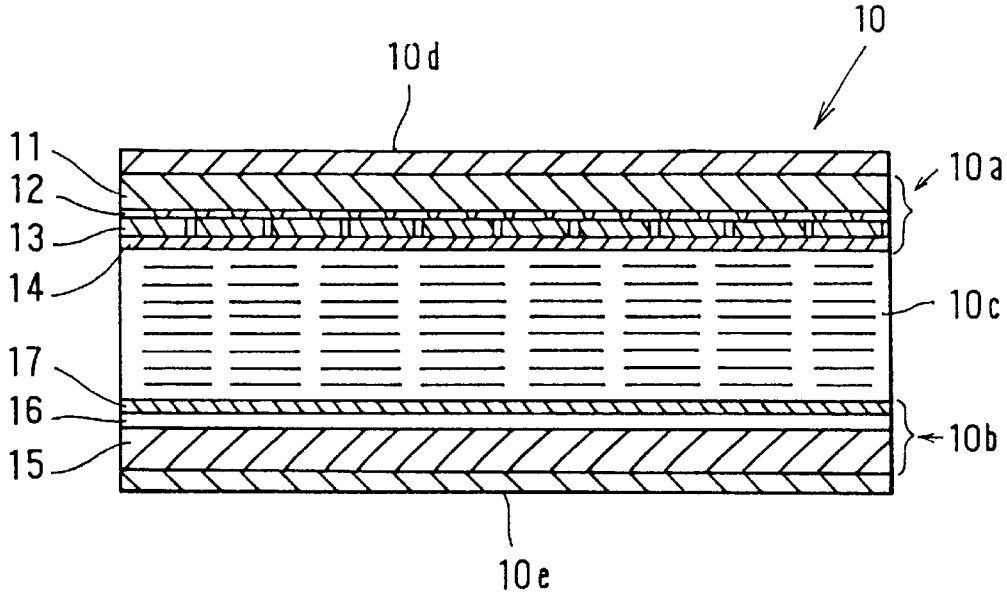
FIG. 2 is a cross-sectional view of a liquid crystal display panel.

FIG. 1 shows a whole structure of a liquid crystal display device with a matrix electrode arrangement. The device includes a liquid crystal display panel 10, as shown in FIG. 1 and FIG. 2. The display panel is composed of electrode plates 10*a* and 10*b*, an anti-ferroelectric liquid crystal 10*c* filling the space between the two plates, and two polarizer layers 10*d* and 10*e* each of which is attached to the outer surface of the respective electrode plates 10*a* and 10*b*.

As shown in FIG. 2, the electrode plate 10*a* is composed of: a glass substrate 11; a color filter layer 12 having m stripes of R (red), G (green) and B (blue), which is disposed on the bottom surface of the glass substrate 11; a transparent electrode layer 13 having m stripes disposed underneath the color filter layer 12; and an orientation film 14 disposed underneath the transparent electrode layer 13.

The electrode plate 10*b* is composed of: a glass substrate 15; a transparent electrode layer 16 having n stripes disposed on the glass substrate 15; and an orientation film 17 disposed on the transparent electrode layer 16.

Figure 3:
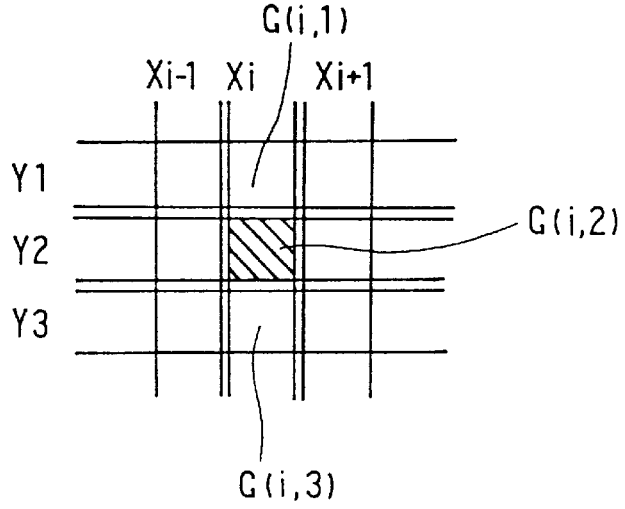
FIG. 3 is a drawing showing a model of pixels of the display panel.

The m stripes of the transparent electrode layer 13 and the n stripes of the transparent electrode layer 16 constitute an (m×n) matrix of pixels together with the anti-ferroelectric liquid crystal 10*c*, as shown in FIG. 3. The pixels, G(1,1), G(1,2) . . . G(m,n) are arranged as shown in FIG. 3. The m stripes of the transparent electrodes 13 correspond to signal electrodes, X1, X2 . . . Xm, in FIG. 1 and the n stripes of the transparent electrodes 16 correspond to scanning electrodes, Y1, Y2 . . . Yn, in FIG. 1.

The polarizer plates 10*d* and 10*e* are disposed in a cross nicol relation. Due to this arrangement, the anti-ferroelectric liquid crystal becomes non-transparent in its anti-ferroelectric state. The two electrode plates 10*a* and 10*b* are kept at a uniform distance of, e. g., 2 μm by a number of spacers not shown in the drawing.

As the anti-ferroelectric liquid crystal material 10*c*, a material for example, 4-(1-trifluoromethylheptoxycarbonylphenyl)-4'-octyloxycarbonylphenyl-4-carboxylate shown in Japanese Patent Laid-Open Publication No. Hei-5-119746 can be used. Some other materials such as a mixture of several kinds of anti-ferroelectric liquid crystal or a mixture of liquid crystal materials including one kind of anti-ferroelectric liquid crystal may be used.

As shown in FIG. 1, the display device includes a control circuit 20, a power source circuit 30, another power source circuit 40, a scanning electrode driving circuit 50 and a signal electrode driving circuit 60. The control circuit 20 delivers output signals, two DPs, DR, S101, S102, SCC, LCK, ACK, STD, and SIC, while receiving a vertical synchronizing signal VSYC and a horizontal synchronizing signal HSYC from outside circuits. One of the DP signals (a first DP), DR signal, S101 signal, S102 signal, ACK signal and SCC signal are fed to the scanning electrode driving circuit 50. The other DP (a second DP), LCK, STD, and SIC signals are fed to the signal electrode driving circuit 60.

The S101 and S102 signals are the signals to decide a condition of the scanning electrodes, Y1, Y2 . . . Yn. In this embodiment, a condition where the S101 signal is L (low) and S102 signal is also L corresponds to an eliminating period of the scanning electrode. Similarly, when S101 is H (high) and S102 is L, the scanning electrode is in a selecting period; when S101 is H and S102 is H, the scanning electrode is in a holding period; and when S101 is L and S102 is H, the scanning electrode is in a refreshing period.

The reason why the refreshing period is provided in the first embodiment will be explained. According to the disclosure of the above-mentioned publication, JP-A-5-119746, voltages applied to the liquid crystal panel are reversed periodically so that a direct current component is not applied to the panel. A transparent state of the panel is realized by using two ferroelectric states alternately, and a non-transparent state is realized by using the anti-ferroelectric state of the anti-ferroelectric liquid crystal. The anti-ferroelectric liquid crystal panel shows different refractive anisotropies (Δn) between the two ferroelectric states when it is seen from slanting directions. Therefore, the display will flicker when the switching frequency between the two ferroelectric states becomes lower than, e.g., 30 Hz. The flicker of this kind is referred to as the slanting direction flicker. In order to eliminate the flicker, it is conceivable to choose a switching frequency which is higher than 30 Hz.

However, there is a certain limit in increasing the switching frequency in consideration of a response speed of the anti-ferroelectric liquid crystal, especially when a higher number of scanning electrodes is required to attain high definition of the display.

A proposal to prevent the slanting direction flicker has been made, for example, in JP-A-4-311920. It proposes to switch the polarity of the applied voltage at a frequency which does not show the flicker during a holding period. However, since the holding voltage is switched or reversed with the same level, a brightness of the panel after the switching does not reach the brightness before the switching. This is because the anti-ferroelectric liquid crystal does not respond as quickly as the polarity changes. Therefore, the brightness of the panel changes every time the polarity is switched, and the flicker on the panel caused by the frequency rewriting pictures on the panel cannot be avoided. Various tests have been done as to how the anti-ferroelectric liquid crystal responds to the voltages applied thereto. Generally, there are three types of the response in the anti-ferroelectric liquid crystal: when it changes from the anti-ferroelectric state to the ferroelectric state, from one of the ferroelectric states to the other ferroelectric state, and from a ferroelectric state to the anti-ferroelectric state. It is necessary that the brightness of the display panel does not change when the polarity of the applied voltage is reversed during a holding period. In other words, it is required to maintain the brightness of the panel at the same level after the polarity of the applied voltage is reversed during the holding period as the level which is attained before the voltage is reversed. If this is done, the polarity of the applied voltage can be reversed during the holding period without causing the flicker.

Figure 9:
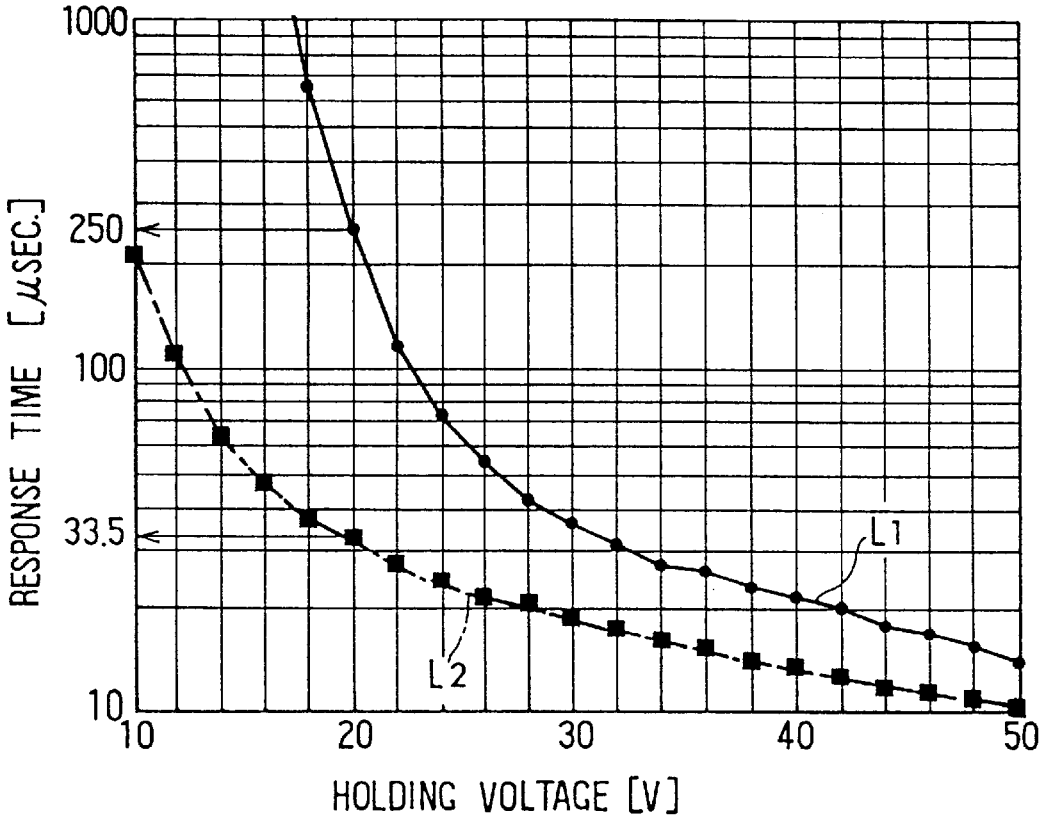
FIG. 9 is a graph showing the response time of an anti-ferroelectric liquid crystal versus voltages applied thereto.

A graph in FIG. 9 shows response time characteristics of the anti-ferroelectric liquid crystal versus voltages applied thereto. In this graph, a curve L1 shows the response time (τr) of the anti-ferroelectric state to the ferroelectric state at a temperature of 40° C., and a curve L2 shows its response time (τ) when it changes from a positive ferroelectric state to a negative ferroelectric state or vice versa at 40° C. According to this graph, when 20 volts is applied, the response time (τr) is 250 μsec., and the response time (τ) is 33.5 μsec. It is apparent that there is a big difference between the response time (τr) and (τ).

This difference can be utilized to change the state of the liquid crystal, regions of which are in one ferroelectric state, to another ferroelectric state, while keeping regions in the anti-ferroelectric state in the same state. This means that it is possible to switch the polarity of the applied voltage during the holding period without causing a visible flicker on the display. In other words, when a refresh voltage (a recovery voltage ) of 20 volts having a duration of 33.5 μsec. is applied at the time of polarity change during the holding period, only the change between the positive and negative ferroelectric states occurs without causing the change from the anti-ferroelectric state to the ferroelectric state. Thus, the visible flicker can be suppressed.

Figure 10:
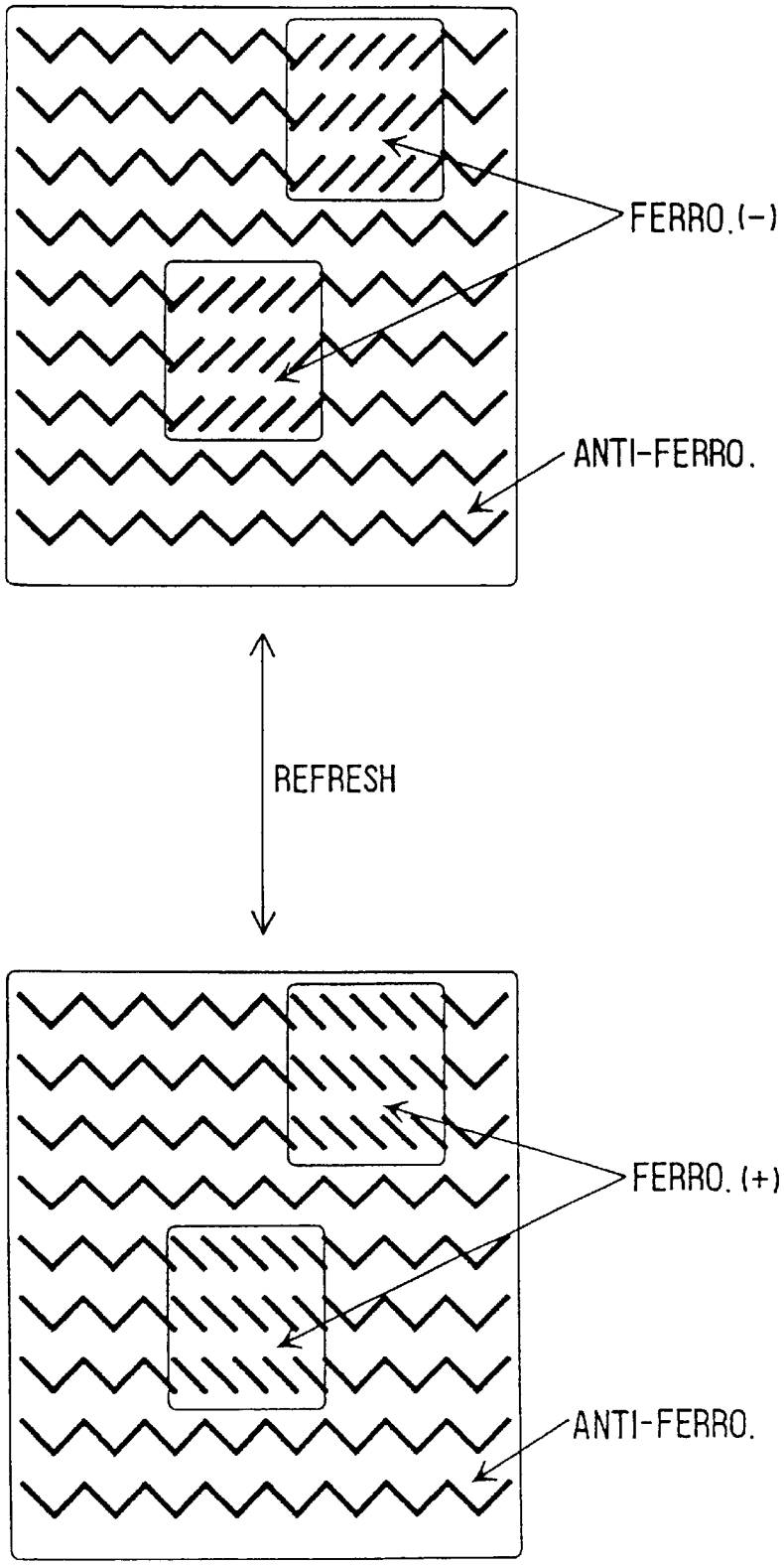
FIG. 10 is a model showing change of states in an anti-ferroelectric liquid crystal when a refresh voltage is applied.

As illustrated in FIG. 10, regions of a pixel which are in one of the ferroelectric states can be changed to the other ferroelectric state by applying such a refresh voltage, while keeping regions which are in the anti-ferroelectric state unchanged. Thus, the brightness of the display can be maintained at the same level before and after the change of the polarity of the voltage applied during the holding period. This can be attained irrespective of the level of brightness, i.e., bright, dark or intermediate levels.

According to the graph of FIG. 9, when the refresh pulse of 20 volts, which is to be applied during the holding period, having a pulse width or duration in a range between the curve L1 and L2 is chosen, the brightness of the panel can be kept at the same level or the brightness change can be minimized before and after the polarity of the holding voltage is reversed. By utilizing the phenomenon mentioned above, the present invention can provide a liquid crystal display device with a matrix electrode structure in which the flicker of the display is substantially invisible.

Turning to FIG. 1 again, the power source circuit 30 delivers seven output voltages, VWP, VRP, VHP, VE, VHN, VRN and VWN, while the other power source circuit 40 outputs nine voltages for displaying eight levels of brightness, V1, V2, V3, V4, V5, V6, V7, V8 and VG.

The scanning electrode driving circuit 50 supplies seven voltage levels sequentially to the scanning electrodes, Y1 . . . Yn, which correspond to the eliminating, selecting, holding and refreshing periods, based on the signals, the first DP, DR, S101, S102, ACK and SCC from the control circuit 20. The driving circuit 50 also switches the polarity of the applied voltages at every selecting period for driving the scanning electrodes by alternating voltages (refer to FIGS. 11 and 12).

Figure 11:
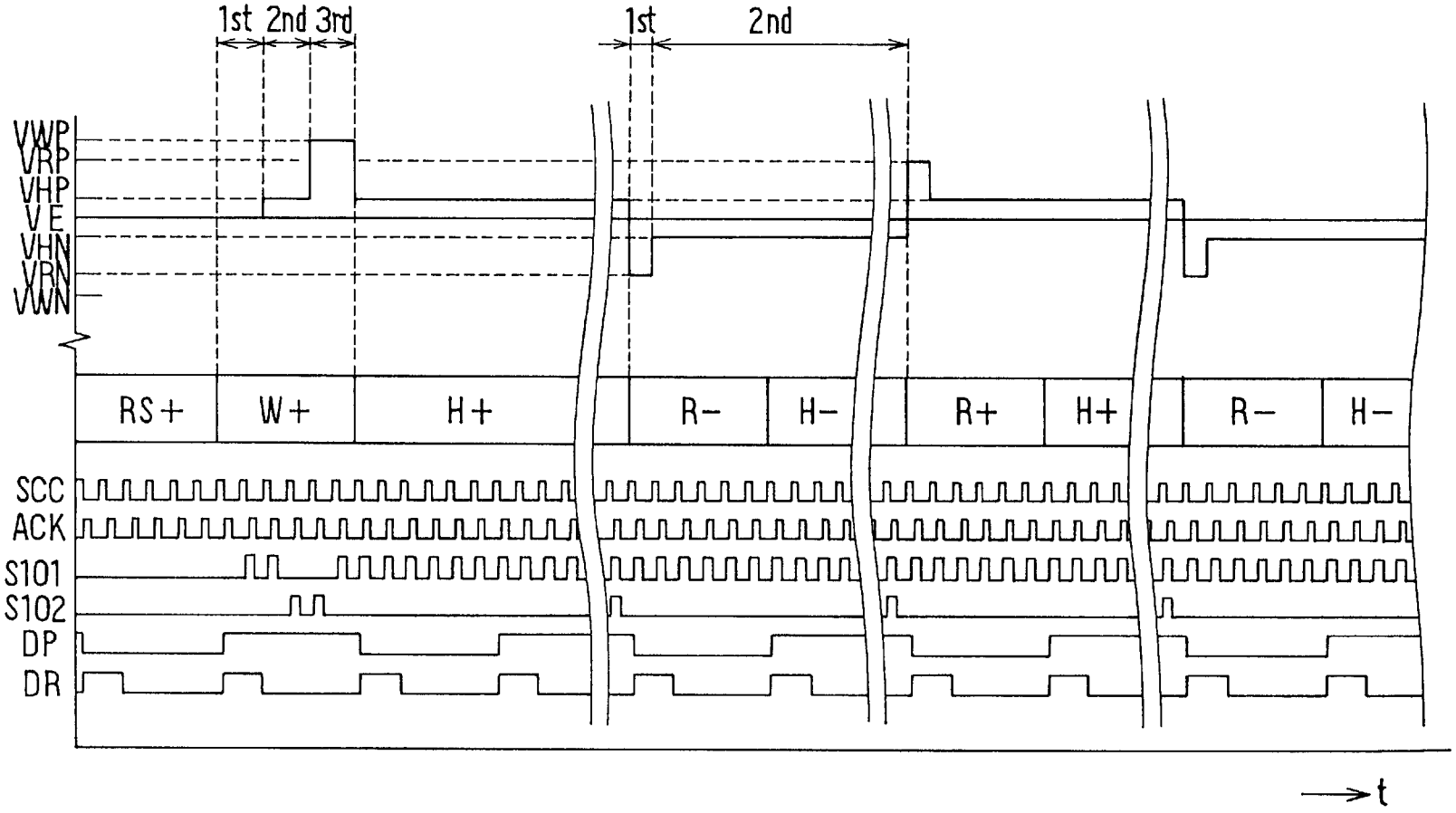
FIG. 11 is a timing chart showing operation of the scanning electrode driving circuit in a first embodiment.
Figure 12:
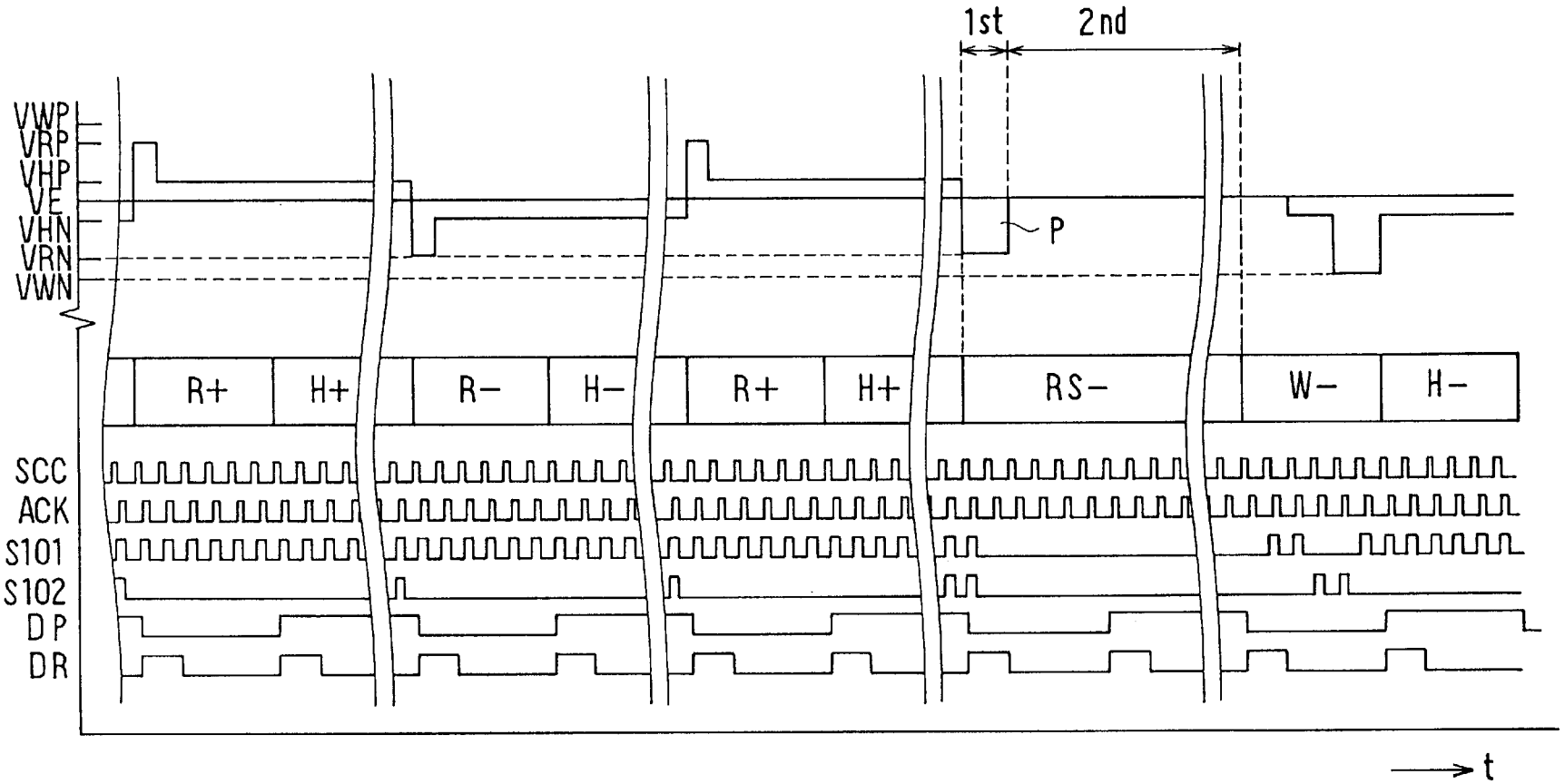
FIG. 12 is a timing chart following the timing chart shown in FIG. 11.

Referring to FIGS. 11 and 12, operation of the scanning electrode driving circuit 50 will be explained, taking a scanning electrode Y1 as an example. In the drawings, the eliminating period is labeled as RS+ or RS− for respective polarities, the selecting period as W+ or W−, the holding period as H+ or H−, and the refreshing period as R+ or R−. The selecting period (W+ in FIG. 11) is divided into three periods, first, second and third periods. The voltage VE which is the same as the voltage applied in the preceding eliminating period is applied in the first period, the positive holding voltage VHP is applied in the second period and the positive selecting voltage VWP in the third period. Picture image data coming from the signal electrodes are imposed on the pixels on the scanning electrode Y1 during the selecting period. In a positive holding period (H+ in FIG. 11), a positive holding voltage VHP is applied to the scanning electrode Y1 and the picture image data is maintained.

A negative refreshing and holding period (R− and H−) is divided into two periods, a first and a second period. A negative refreshing voltage VRN is applied to the scanning electrode in the first period. The first period corresponds to a period during which a voltage VG is delivered from the signal electrode driving circuit 60 as described later, and the polarity of the holding voltage is reversed in this period while maintaining the image data as before. A negative holding voltage VHN is applied in the second period. Then, a positive refreshing and holding period (R+ and H+) follows. During this period, a voltage VRP is applied to the scanning electrode in the first period which corresponds to the period in which the voltage VG is delivered from the signal electrode driving circuit 60, and the polarity of the holding voltage is reversed while maintaining the image data as before. A voltage VHP is applied in the second period and the image data are maintained. The positive refreshing and holding period and the negative refreshing and holding period are alternately repeated thereafter as shown in FIGS. 11 and 12 up to the next selecting period (RS−). The negative eliminating period (RS−) is divided into two periods, first and second periods. A voltage VRN labeled as P in FIG. 12 is applied to the scanning electrode in the first period, and then the voltage VE in the second period. Thus, all the image data on the scanning electrode are eliminated.

The operation described for the scanning electrode Y1 is applied in the same manner to other scanning electrodes, Y2 . . . Yn. The scanning from the electrode Y1 through the electrode Yn is done sequentially with a phase difference of the duration of the selecting period. In order to prevent the flicker on the display, the polarity of neighboring scanning electrodes is alternately selected, in such a way that, for example, Y1 is positive, Y2 is negative, Y3 is positive, and so forth.

Figure 4:
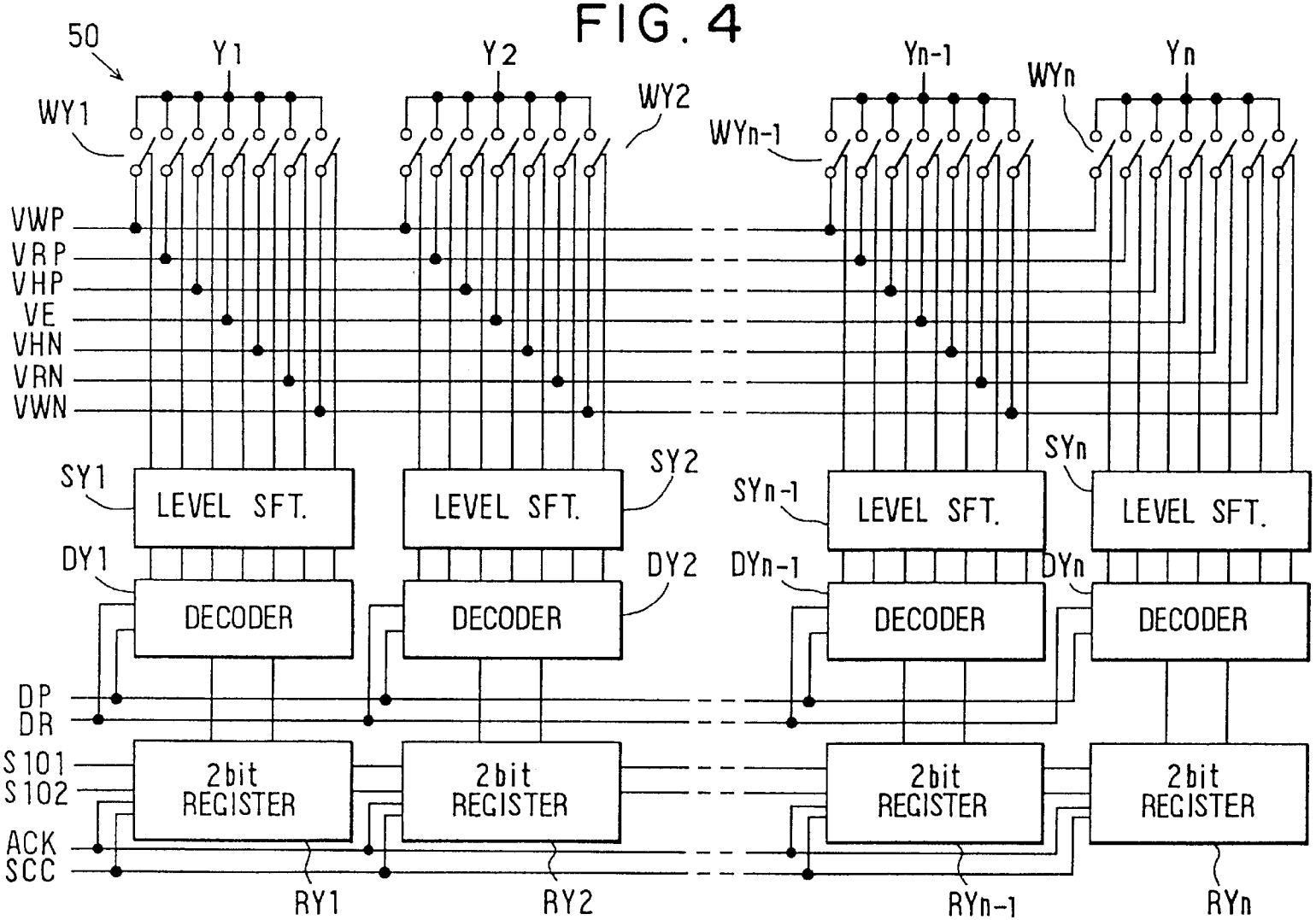
FIG. 4 is a diagram showing a scanning electrode driving circuit.

The structure of the scanning electrode driving circuit 50 will be explained referring to FIG. 4.

The scanning electrode driving circuit 50 includes n 2-bit registers (RY1, RY2 . . . RYn), n decoder circuits (DY1, DY2 . . . DYn), n level shifters (SY1, SY2 . . . SYn), and n analog switch circuits (WY1, WY2 . . . WYn). Each of the analog switch circuits includes seven analog switches. The scanning electrode driving circuit 50 performs the function mentioned above based on six kinds of signals received from the control circuit 20.

The 2-bit registers (RY1, RY2 . . . RYn) sequentially receive S101 and S102 signals from the control circuit 20 in synchronism with the rising of a ACK signal, and output 2-bit data (bit-1 and bit-2) to the decoder circuits (DY1, DY2 . . . DYn) in synchronism with the rising of SCC signal.

Figure 5:
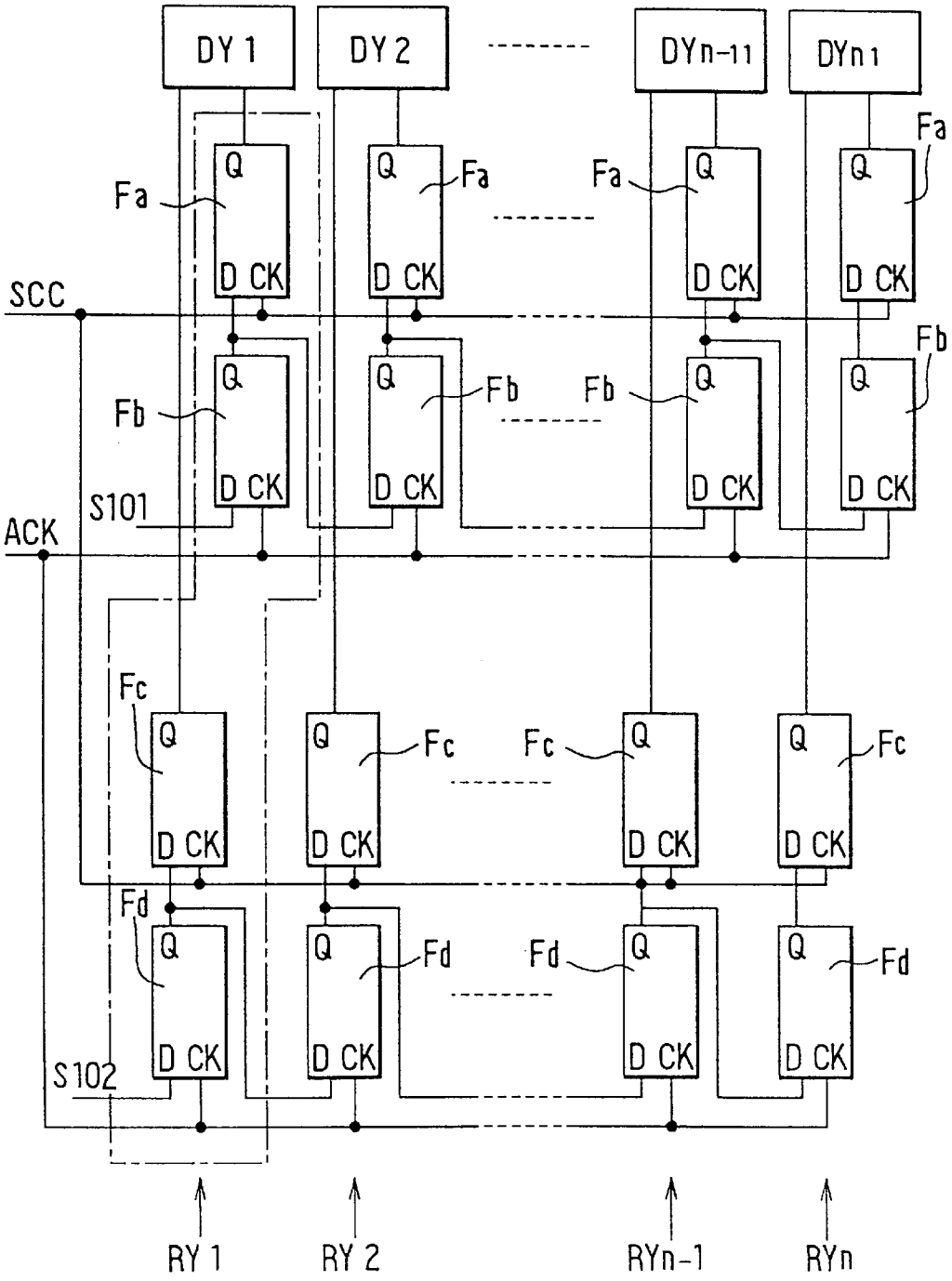
FIG. 5 is a diagram showing a 2-bit register used in the scanning electrode driving circuit shown in FIG. 4.

Details of the 2-bit registers RY1 to RYn are shown in FIG. 5. The structure of the 2-bit registers will be described, taking the 2-bit registers RY1 and RY2 as examples. The 2-bit register RY1 is composed of a pair of D-type flip-flops Fa, Fb constituting an 1-bit and a pair of D-type flip-flops Fc, Fd constituting another 1-bit. The flip-flops Fb, Fd receive the signals S101, S102, respectively, in synchronism with the rising of the ACK signal, and deliver their outputs from respective Q terminals to the flip-flops Fa, Fc, respectively. The flip-flops Fa, Fc receive the outputs from the flip-flops Fb, Fd, respectively, in synchronism with the rising of the SCC signal, and deliver their outputs to the decoder DY1 as the 2-bit data (bit-1 and bit-2). Similarly, the 2-bit register RY2 is composed of a pair of D-type flip-flops Fa, Fb and another pair of D-type flip-flops Fc, Fd. The flip-flops Fb, Fd of RY2 receive the outputs from respective Q terminals of the flip-flops Fb, Fd of RY1, respectively, in synchronism with the rising of the ACK signal, and deliver their outputs from respective Q terminals to the flip-flops Fa, Fc of RY2, respectively. The flip-flops Fa, Fc of RY2 receive the outputs from the flip-flops Fb, Fd of RY2, respectively, in synchronism with the rising of the SCC signal, and deliver their outputs to the decoder DY2 as 2-bit data (bit-1 and bit-2). Other 2-bit registers RY3 to RYn operate in the same manner and deliver their outputs as the 2-bit data to DY3 to DYn, respectively. The decoders DY1 to DYn generate seven signals for operating the analog switches WY1 to WYn, based on the 2-bit data from the 2-bit registers RY1 to RYn, the first DP signal from the control circuit 20.

Figure 6:
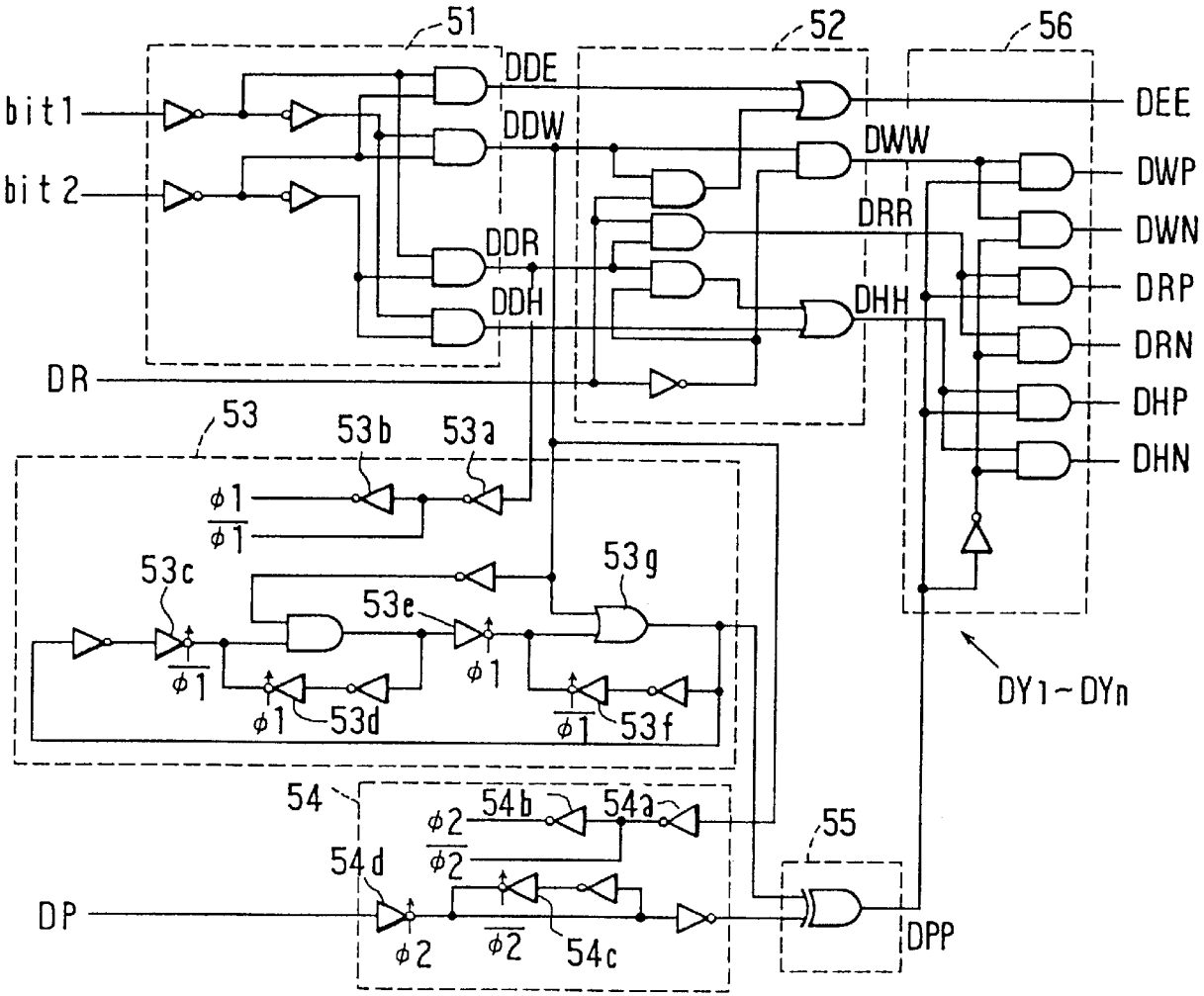
FIG. 6 is a detailed diagram showing a decoder circuit used in the scanning electrode driving circuit shown in FIG. 4.

The decoder circuits (DY1, DY2 . . . DYn) produce signals of seven kinds which perform switching operations on the analog switch circuits (WY1, WY2 . . . WYn), based on the 2-bit data from the 2-bit registers (RY1, RY2 . . . RYn) and the first DP signal and the DR signal from the control circuit 20. Each of the decoder circuits (DY1, DY2 . . . DYn) is composed of six logic circuits 51 through 56 as shown in FIG. 6. The operation of the decoder circuit will be explained taking DY1 as an example.

The logic circuit 51 composed of four inverters and four AND gates, as shown in FIG. 6, decodes the 2-bit data (bit-1 and bit-2) received from the 2-bit register RY1, and converts them into signals, DDE, DDW, DDR and DDH which perform a switching function. During the eliminating period (S101 is L and S102 is L), only the DDE signal becomes H (high) and other signals become L (low). During the selecting period (S101 is H and S102 is L), only the DDW signal becomes H and other signals become L. During the refreshing period (S101 is L and S102 is H), only the DDR signal becomes H and other signals become L. During the holding period (S101 is H and S102 is H), only the DDH signal becomes H and other signals become L.

The logic circuit 52 composed of four AND gates, an inverter and two OR gates, as shown in FIG. 6, controls switching signals from the logic circuit 51 based on the DR signal, and outputs the signals of DEE, DWW, DRR and DHH. When the DDE signal is H, only the DEE signal becomes H. When the DDW signal is H, only the DEE signal becomes high during the time when the DR signal is H, and only the DWW signal becomes H during the time when the DR signal is L. When the DDR signal is H. only the DRR signal becomes H during the time when the DR signal is H, and only the DHH signal becomes H during the time when the DR signal is L. When the DDH signal is H, only the DHH signal becomes H.

The logic circuit 53 is composed of elements shown in FIG. 6. In the logic circuit 53, clocked inverters 53*c* and 53*f* are operated by an inverted output from an inverter 53*a*, and clocked inverters 53*d* and 53*e* are operated by a cascade output from the inverters 53*a* and 53*b*. According to the operation of the clocked inverters and other logic gates, the logic circuit 53 is reset when the DDW signal is H and reverses an output of an OR gate 53*g* in synchronism with rising of the DDR signal.

The logic circuit 54 is composed of elements shown in FIG. 6 and performs a function of latching data. In the logic circuit 54, a clocked inverter 54*c* is operated by an inverted output from an inverter 54*a* which inverts the DDW signal, and a clocked inverter 54*d* is operated by a cascade output from the inverters 54*a* and 54*b*. According to the operation of the clocked inverters and other logic gates, the logic circuit 54 outputs the first DP signal as it is when the DDW signal is H, and latches the first DP signal when the DDW signal is L.

The logic circuit 55 is composed of an exclusive OR gate and outputs an exclusive logical sum of the outputs from the logic circuits 53 and 54 as a DPP signal to the logic circuit 56. During the time when the DDW signal is H, the DPP signal corresponds to the first DP signal and its voltage polarity is controlled by the first DP signal, because the logic circuit 53 is reset and its output becomes L and the logic circuit 54 outputs the same output as the output of the logic circuit 53. When the DDW signal becomes L, the DPP signal becomes independent from the first DP signal because the logic circuit 54 performs the latch function. Since the logic output from the logic circuit 53 is reversed in synchronism with the rising of the DDR signal, the DPP signal is reversed every time the DDR signal rises and the voltage polarity is reversed at every refreshing period.

The logic circuit 56 composed of six AND gates as shown in FIG. 6 switches the voltage polarity according to the signals from the logic circuit 52 and the DPP signal from the logic circuit 55. When the DWW and DPP signals are H, the DWP signal becomes H. When the DWW signal is H and the DPP signal is L, the DWN signal becomes H. When the DRR and DPP signals are H, the DRP signal becomes H. When the DRR signal is H and the DPP signal is L, the DRN signal becomes H. When the DHH and DPP signals are H, the DHP signal becomes H. When the DHH signal is H and the DPP signal is L, the DHN signal becomes H. The seven control signals DEE, DWP, DWN, DRP, DRN, DHP, and DHN are thus synthesized.

The DEE signal controls the analog switch (refer to FIG. 4) connected to a VE terminal of the power source circuit 30 through the level shifter. The DWP signal controls the analog switch connected to a VWP terminal of the power source circuit 30 through the level shifter. The DWN signal controls the analog switch connected to a VWN terminal of the power source circuit 30 through the level shifter. The DRP signal controls the analog switch connected to the VRP terminal of the power source circuit 30 through the level shifter. The DRN signal controls the analog switch connected to the VRN terminal of the power source circuit 30 through the level shifter. The DHP signal controls the analog switch connected to the VHP terminal of the power source circuit 30 through the level shifter. The DHN signal controls the analog switch connected to the VHN terminal of the power source circuit 30 through the level shifter. When a control signal is H, a corresponding analog switch becomes closed (ON) and a corresponding voltage is supplied from the power source circuit 30 to the scanning electrode. This applies to each one of the control signals (DEE, DWP, DWN, DRP, DRN, DHP and DHN).

Thus, voltages having a predetermined waveform as shown in FIGS. 11 and 12 are supplied to each scanning electrode (Y1, Y2 . . . Yn) according to the signals SCC, ACK, S101, S102 and first DP.

Figure 7:
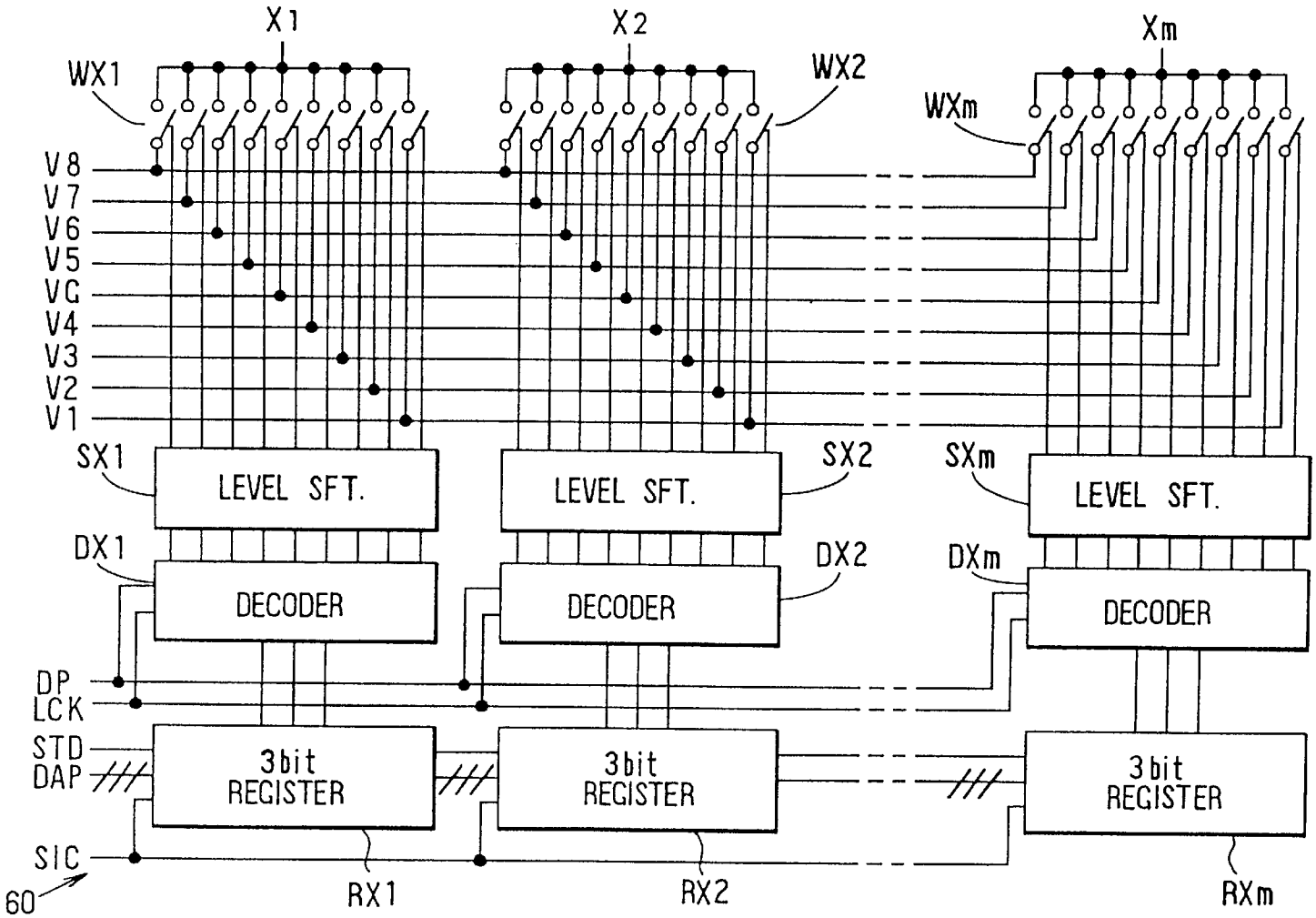
FIG. 7 is a diagram showing a signal electrode driving circuit.

The signal electrode driving circuit 60, as shown in FIG. 7, is composed of m 3-bit registers (RX1, RX2 . . . RXm), m decoder circuits (DX1, DX2 . . . DXm), m level shifters (SX1, SX2 . . . SXm) and m analog switches (WX1, WX2 . . . WXm). The signal electrode driving circuit 60 supplies signal voltages of nine levels from the power source circuit 40 to the signal electrodes (X1, X2 . . . Xm) according to the picture image signal DAP from the outside and the signals, second DP, LCK, STD and SIC from the control circuit 20. The DAP signal is a 3-bit signal because the liquid crystal panel displays images having eight brightness steps.

Figure 13:
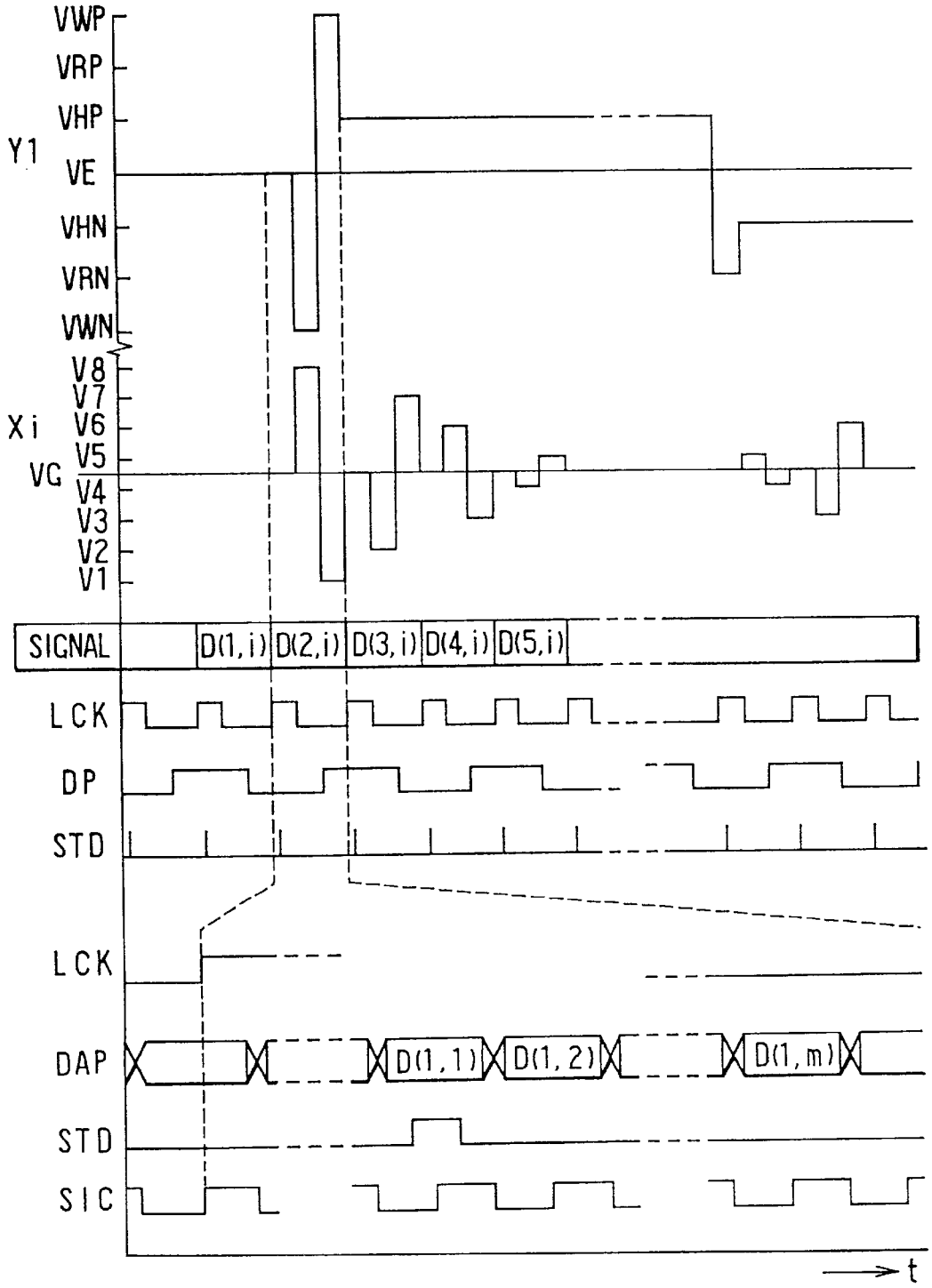
FIG. 13 is a timing chart showing operation of the signal electrode driving circuit in the first embodiment.

The operation of the signal electrode driving circuit 60 will be explained referring to the timing chart shown in FIG. 13. The picture image signals DAP having 3-bit data are sent from the outside to the signal electrode driving circuit 60 as a series of data for all of the signal electrodes (X1, X2, . . . Xm). The picture image data are sent from the outside to the signal electrode driving circuit 60 sequentially, i.e., the data for the pixels on the scanning electrode Y1 come first and the data for the pixels on the scanning electrode Y2 come next, and the data come continuously in this way till the scanning electrode Yn. In FIG. 13, D(1,i) denotes a series of picture image data for pixels on the scanning electrode Y1, and D(1,1), D(1,2) . . . D(1,m), each denotes the picture image datum for the respective signal electrode, X1, X2 . . . Xm. When the STD signal is H, the picture image signal corresponding to the signal electrode X1 is fed to the 3-bit register in synchronism with the rising of the SIC signal. Similarly, the picture image signals corresponding to the signal electrodes, X2, X3 . . . Xm are sequentially fed to the 3-bit registers in synchronism with the rising of the SIC signal. Thus, the picture image data for the pixels on the one scanning electrode are stored in the 3-bit registers, RX1, RX2 . . . RXm. The data stored in the 3-bit registers are fed to the decoder circuits.

Figure 8:
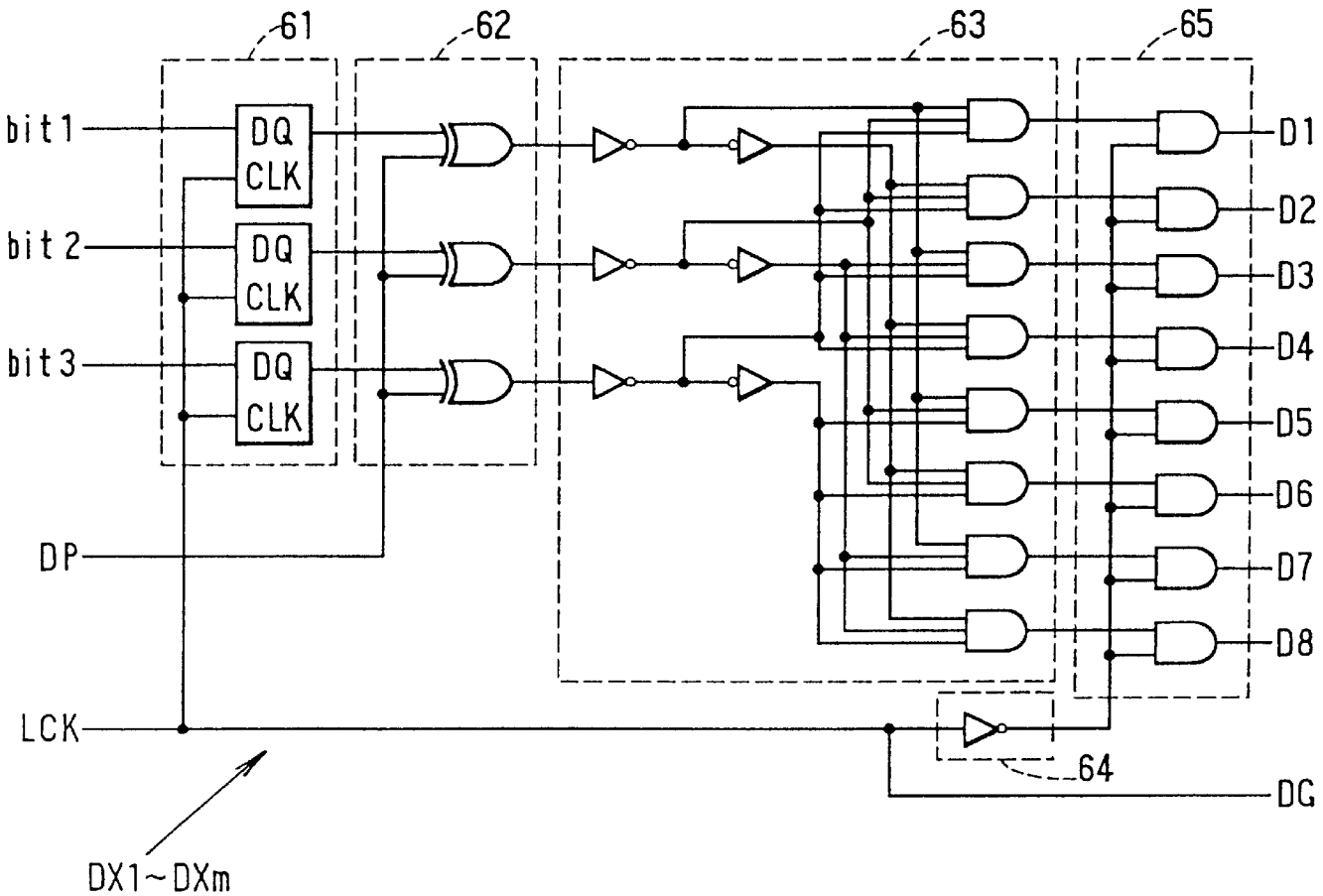
FIG. 8 is a diagram showing a decoder circuit used in the signal electrode driving circuit shown in FIG. 7.

As shown in FIG. 8, each of the decoders, DX1, DX2 . . . DXm, has five logic circuits 61, 62, 63, 64 and 65. The operation of the decoders will be explained with reference to FIG. 8, taking DX1 as an example.

The logic circuit 61 composed of three D-type flip-flops latches the 3-bit picture image data in synchronism with a rising of the LCK signal from the control circuit 20. The logic circuit 62 composed of three exclusive OR gates reverses the picture image signals latched by the logic circuit 61 when the second DP signal from the control circuit 20 is H. The logic circuit 63 is composed of three pairs of inverters and eight AND gates, and constitutes a decoder. The logic circuit 63 decodes the 3-bit picture image data signals from the logic circuit 62 and converts them to eight line outputs. The logic circuit 64 composed of an inverter reverses the LCK signal from the control circuit 20. The logic circuit 65 having eight AND gates receives signals from the logic circuit 63 and outputs control signals, D1, D2 . . . D8, which switch the eight analog switches of the analog switch circuit WX1, according to the outputs from the logic circuit 64. Also, the decoder circuit DX1 outputs the LCK signal as a control signal DG.

The decoder circuit DX1 constituted as mentioned above makes its respective outputs, D1 through D8, high (H) when the 3-bit data latched by the logic circuit 61 are respectively (L,L,L), (L,L,H), . . . (H,H,L), (H,H,H), under the condition that the second DP signal is L and the LCK signal is L. Under the condition that the second DP signal is H and the LCK signal is L, the decoder circuit DX1 makes its respective outputs, D8 through D1, high (H) in this order when 3-bit data latched by the logic circuit 61 are respectively (L,L,L), (L,L,H), . . . (H,H,L), (H,H,H). Under the condition that the LCK signal is H, the outputs D1 through D8 become L irrespective of the 3-bit data, and only the output DG becomes H.

The outputs D1 through D8 and the output DG from the decoder control the analog switches connected to the voltages V1 through V8 and VG of the power source circuit 40, respectively, through the level shifter (refer to FIG. 7). When the outputs D1 through D8 and the output DG are H, corresponding analog switches become ON and the output voltages from the power source circuit 40 are supplied to the signal electrode.

After the picture image data for pixels on a scanning electrode are latched by the logic circuit 61 in synchronism with the rising of the LCK signal, the 3-bit registers (RX1 through RX2) begin to input the picture image data for the pixels on a next scanning electrode. Accordingly, as seen from the timing chart shown in FIG. 13, voltage outputs having prescribed waveforms are supplied to the signal electrodes X1 through Xm in response to the signals SIC, STD, LCK and second DP and picture image data DAP.

The output voltage VE from the power source circuit 30 and the output voltage VG from the power source circuit 40 are set at a common level. The signals, SCC, first DP and LCK, are synchronized with the signals, LCK and second DP, all signals being fed from the controller circuit 20. The picture image data for the pixels on a scanning electrode which is in the selecting period are input in advance by one selecting period. Thus, the waveforms shown in FIG. 14 are realized.

The operation of an example of the liquid crystal display device constructed according to the present invention, in which a display period of one-frame is 50 ms, number of rows (scanning electrodes) is 1024, number of columns (signal electrodes) is 3840, a scanning duty is 1/N (N=512, divided into two, upper and lower frames) and an eliminating period is R which is determined according to a response time of the anti-ferroelectric liquid crystal from the ferroelectric state (F) to the anti-ferroelectric state (AF), will be explained below.

Figure 14:
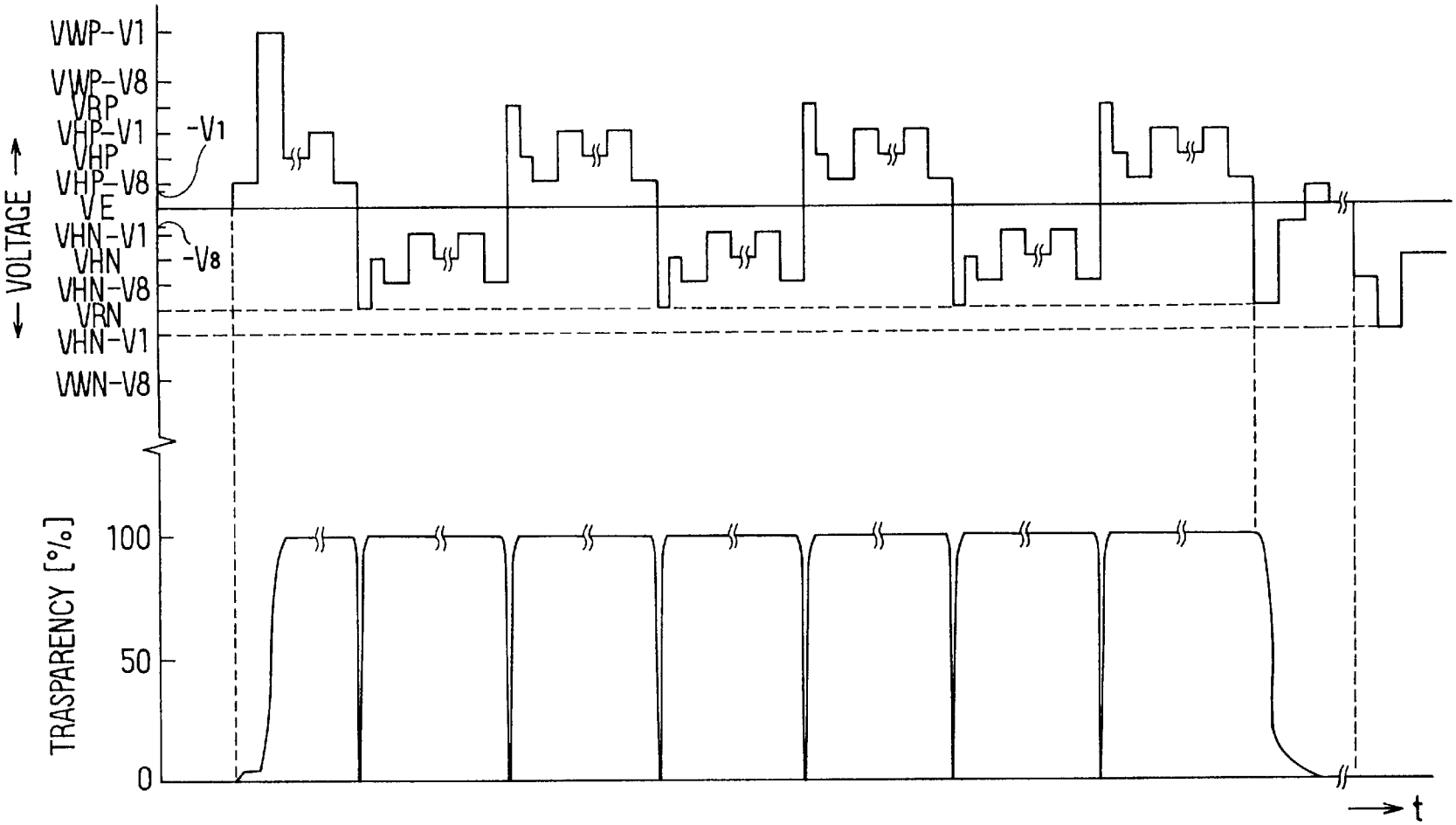
FIG. 14 is a timing chart showing a driving voltage applied to a pixel of the display panel and transparency of the anti-ferroelectric liquid crystal in the first embodiment.
Figure 15:
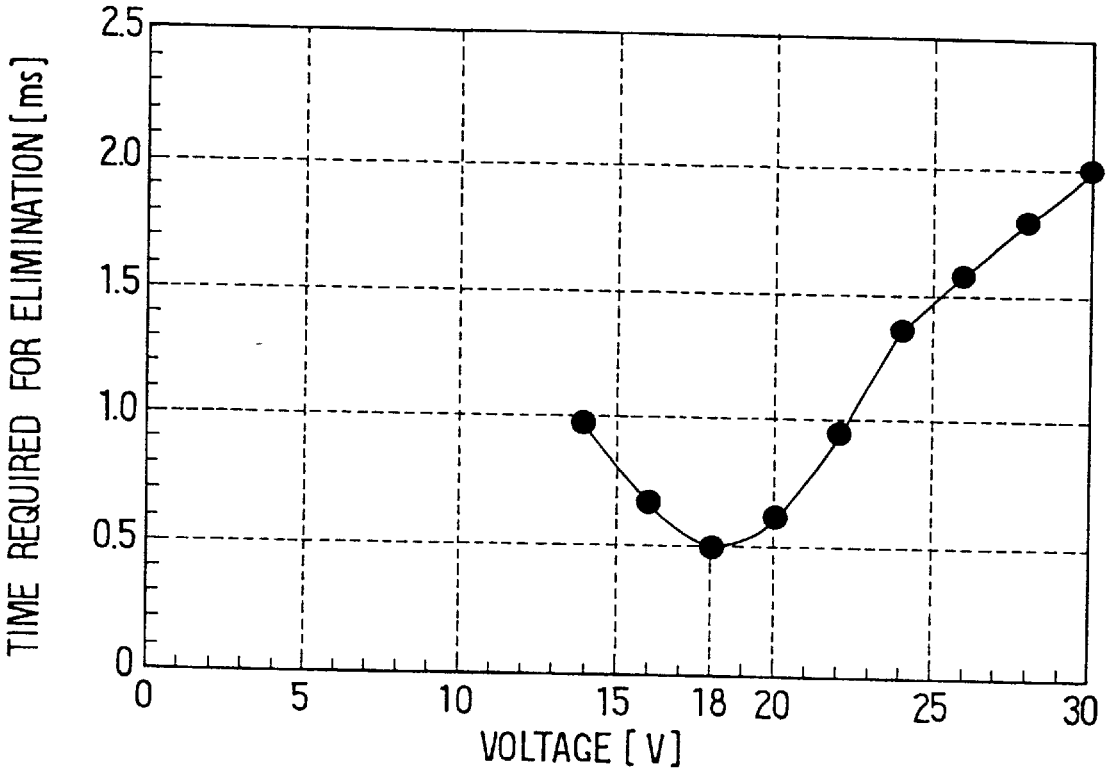
FIG. 15 is a graph showing relation between a voltage applied to the scanning electrode in an eliminating period and time required for elimination in the first embodiment.

Driving voltages having a waveform shown in FIG. 14 are applied to each pixel G(i,j) shown in FIG. 3. The selecting voltage VW is set at 28 V, and the holding voltage VH is set at 9.5 V in the first embodiment. When the driving voltages shown in FIG. 14 are applied to a pixel, the anti-ferroelectric liquid crystal optically responds to the driving voltages as shown in the bottom graph of FIG. 14. It is seen from the graph that the state of anti-ferroelectric liquid crystal rapidly changes from the ferroelectric state toward the anti-ferroelectric state by applying the first pulse in the eliminating period and reaches the complete anti-ferroelectric state by applying voltage VE thereafter. The response time (a length of time required for elimination) from the ferroelectric state to the anti-ferroelectric state varies as shown in the graph of FIG. 15 according to the level of the eliminating voltage VRP (or VRN in the negative polarity). The level of voltage VRP is shown on the abscissa and the time required for elimination is shown on the ordinate in the graph. It is seen in the graph that the response time becomes the shortest, 0.5 ms when voltage VRP is 18 V. When the voltage is lower than 18 V, the response time becomes longer. Similarly, the response time becomes longer when the voltage is higher than 18 V because the anti-ferroelectric liquid crystal is induced to change its state from one ferroelectric state to another ferroelectric state in this case. When the response time is at the minimum level, 0.5 ms, no flicker is seen on the display because the elimination period is at a level of 1% of a display period of one-frame (50 ms). The brightness of display reaches 99% of a theoretical maximum in this case.

As described above, a pulse voltage having an opposite polarity to the holding voltage preceding the eliminating period is applied at the beginning of the eliminating period and then voltage VE is applied in the first embodiment. Thus, the display can be switched at a high speed, and both moving and still images can be displayed with a high quality without lowering brightness, while avoiding the double image display on the panel. In addition, the display flicker is avoided by switching the polarities of the refresh pulse voltage and the holding voltage during the refreshing and holding period. In other words, the first embodiment realizes a high speed switching of the display and prevents flicker at the same time. Also, the cross-talk along the longitudinal direction of the signal electrode is avoided because the pixels can be converted to the anti-ferroelectric state or a state close thereto in a short period of time. Though voltage VRP (or VRN) is used as the eliminating pulse voltage in this embodiment, VHP (or VHN) may be used as the eliminating pulse voltage. Alternatively, a specific voltage which is suitable for elimination may be provided, in addition to the seven voltages, in the power source circuit 30.

Figure 16:
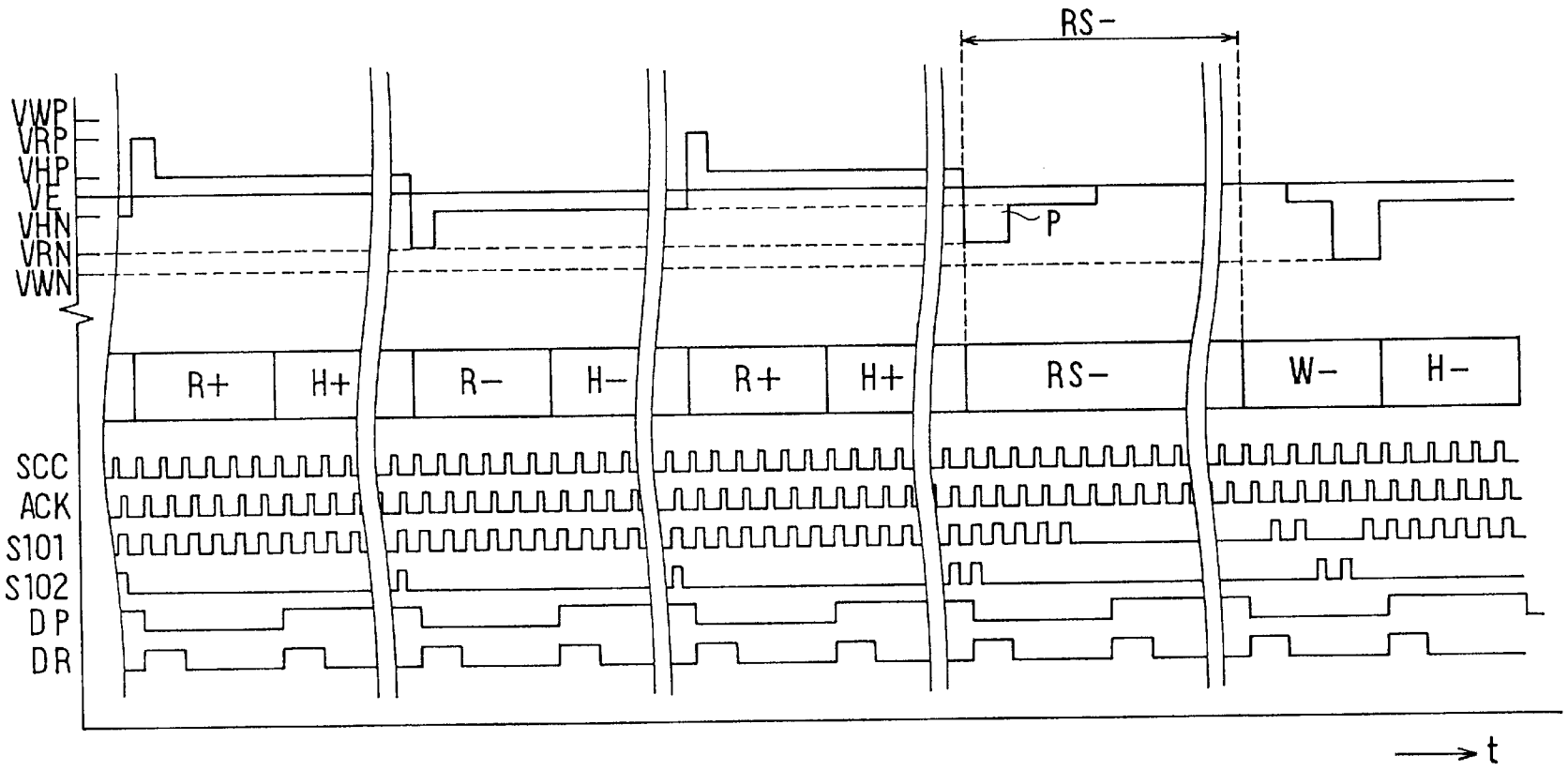
FIG. 16 is a timing chart showing operation of the scanning electrode driving circuit in a modification of the first embodiment.
Figure 17:
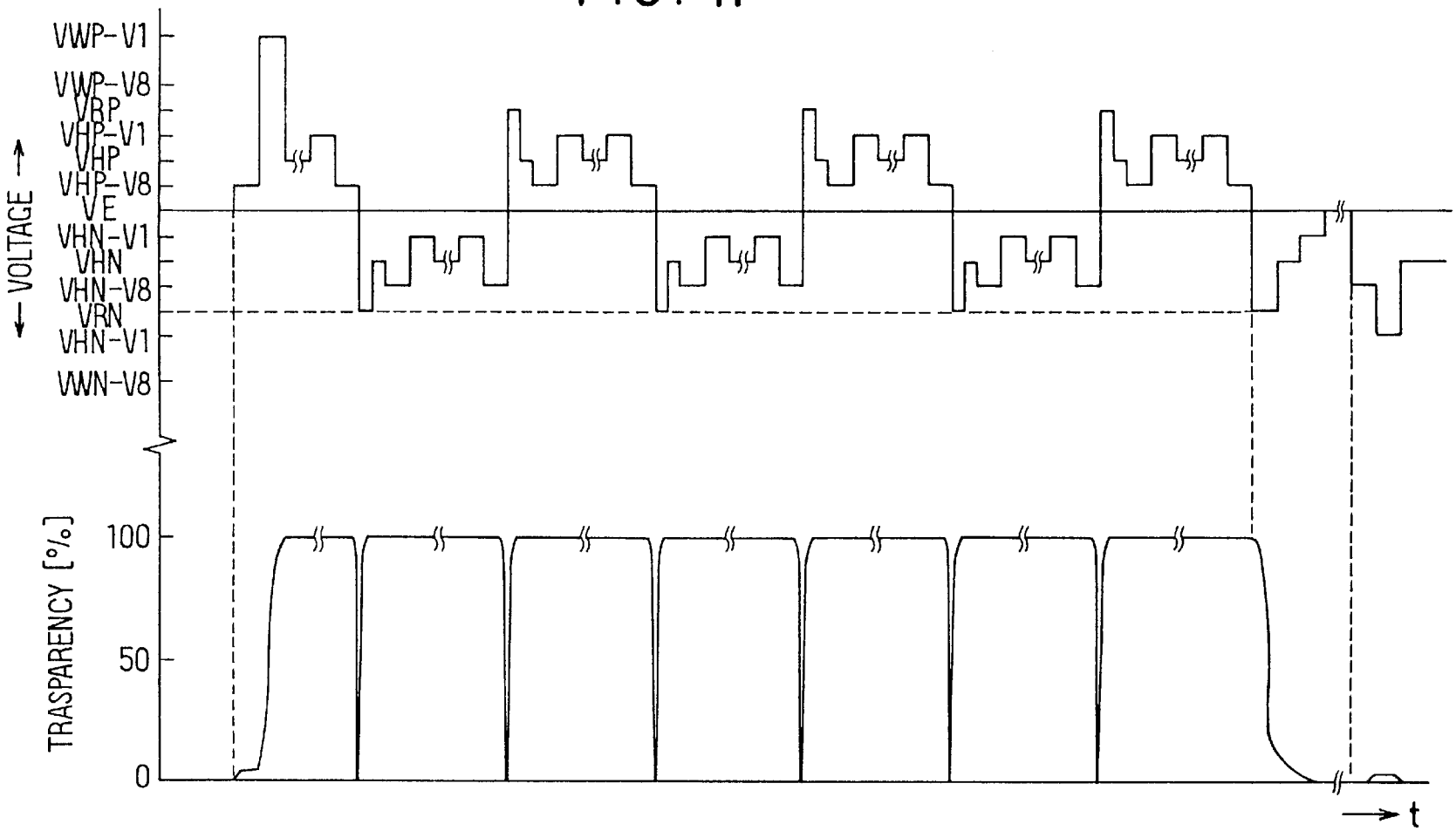
FIG. 17 is a timing chart showing a driving voltage applied to a pixel of the display panel and transparency of the anti-ferroelectric liquid crystal in the modification of the first embodiment.
Figure 18:
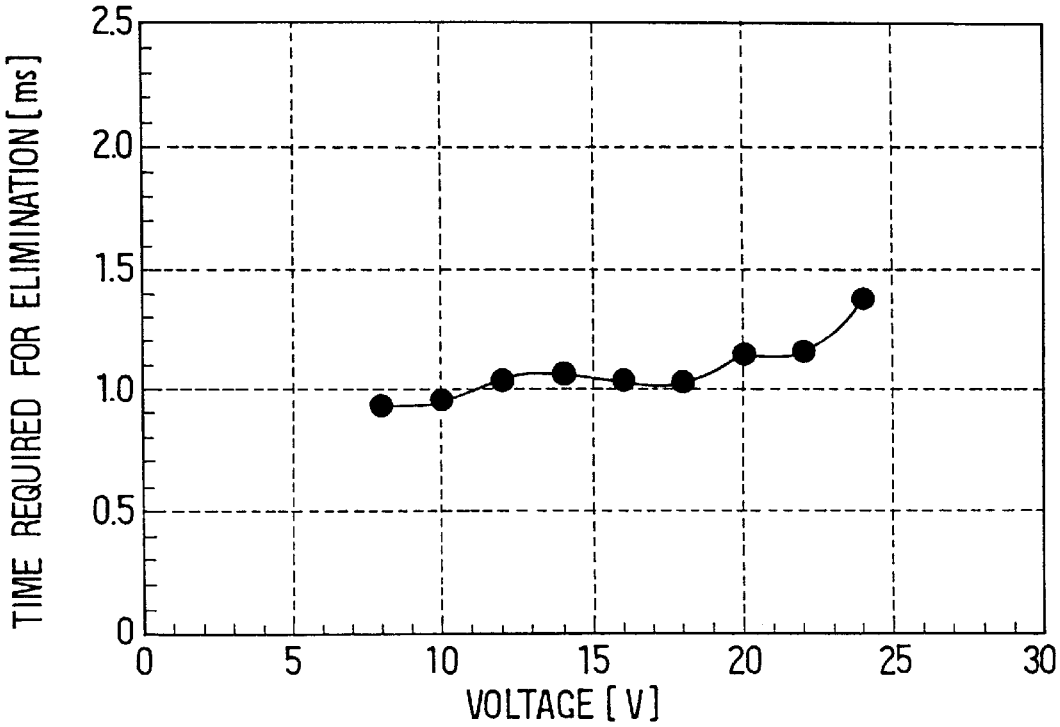
FIG. 18 is a graph showing relation between a voltage applied to the scanning electrode in an eliminating period and time required for elimination in the modification of the first embodiment.

FIGS. 16 to 18 show a modified form of the first embodiment. In this modification, the first pulse voltage applied to the scanning electrode at the beginning of the eliminating period is voltage VRN (or VRP in the positive polarity) which is the same as in the first embodiment. Then, voltage VHN (or VHP) which has the same level as the holding voltage is applied as shown in FIG. 16. After that, voltage VE is applied. By additionally applying voltage VHN, the state of the anti-ferroelectric liquid crystal can be changed effectively from the ferroelectric state to the anti-ferroelectric state. Since voltage VHN is the same as the holding voltage, it is not necessary to increase the number of voltage levels supplied from the power source circuit 30. The optical response (transparency change) of the anti-ferroelectric liquid crystal in this modification is shown in FIG. 17. The response time (time required for elimination) versus the level of voltage VRN is shown in the graph of FIG. 18. As seen from the graph, the response time is about 1.0 ms in a range of voltage VRN from 8 to 18 V. The response time 1.0 ms from the ferroelectric state to the anti-ferroelectric state is about a half of that of the conventional device. In this particular embodiment, voltage VRN (or VRH) is set at 17 V. This modified form of the first embodiment also realizes a high speed display switching and avoids the display flicker at the same time without causing the cross-talk.

(Second Embodiment)

Figure 19:
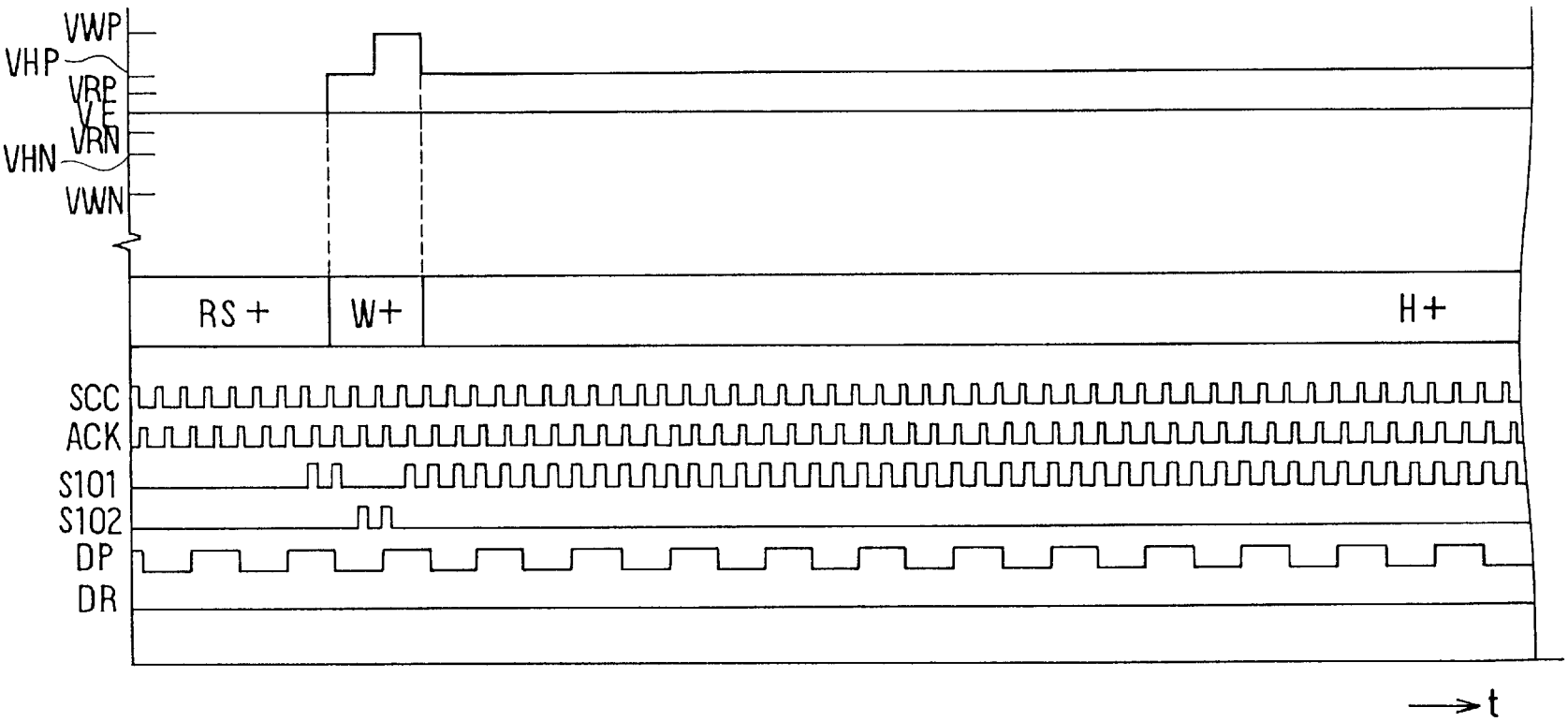
FIG. 19 is a timing chart showing operation of the scanning electrode driving circuit in a second embodiment.
Figure 20:
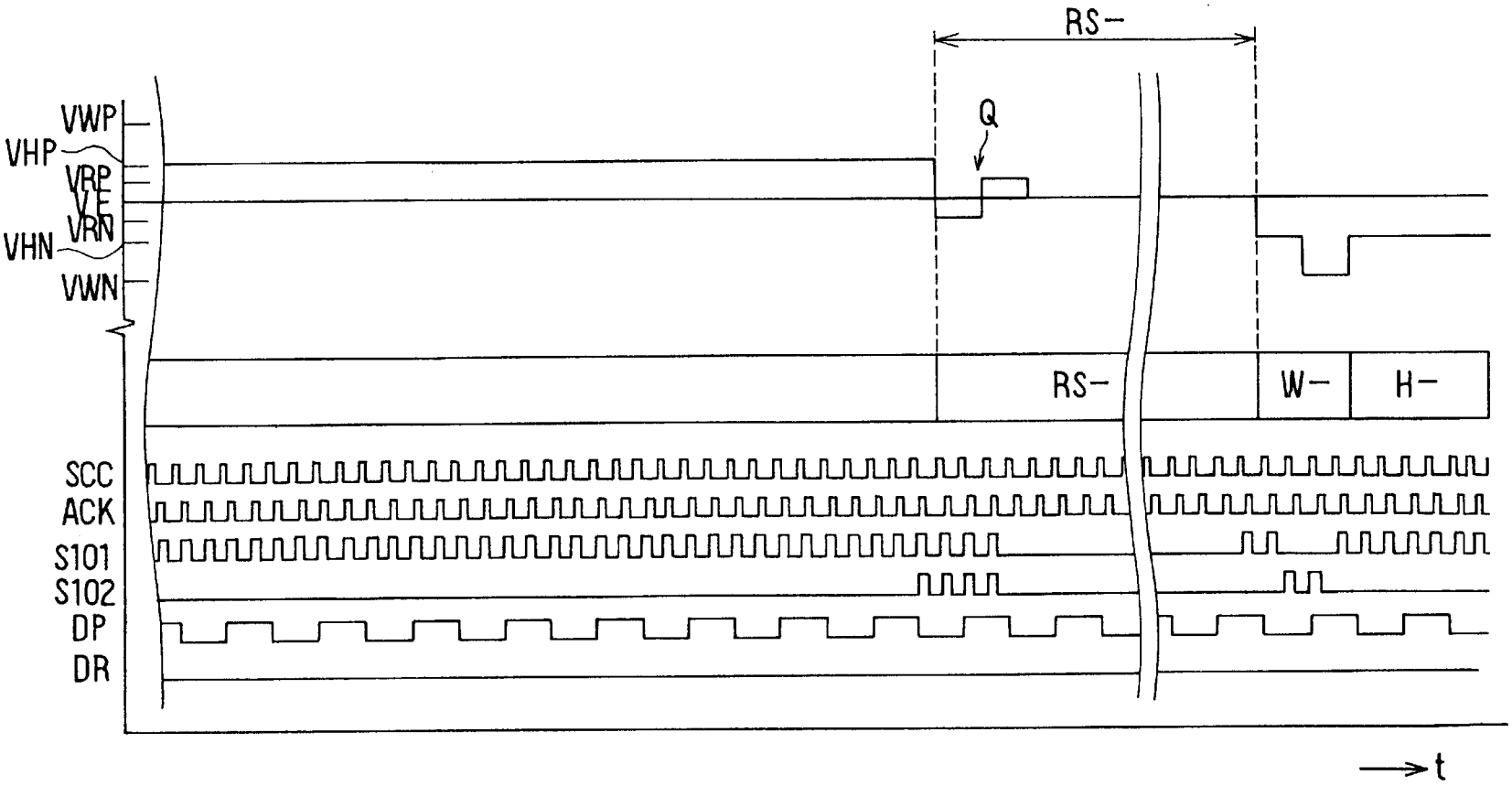
FIG. 20 is a timing chart following the timing chart shown in FIG. 19.
Figure 21:
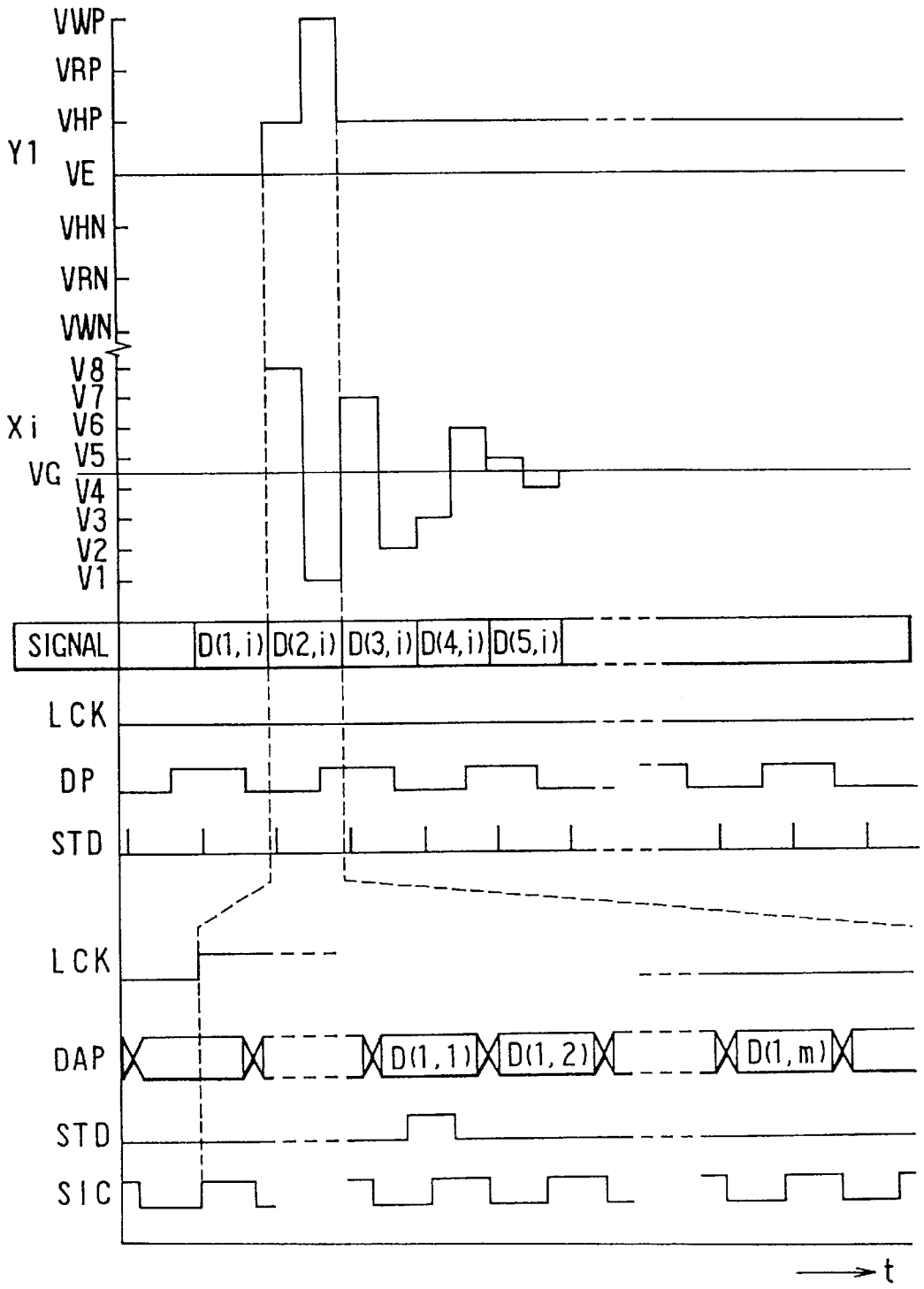
FIG. 21 is a timing chart showing operation of the signal electrode driving circuit in the second embodiment.
Figure 22:
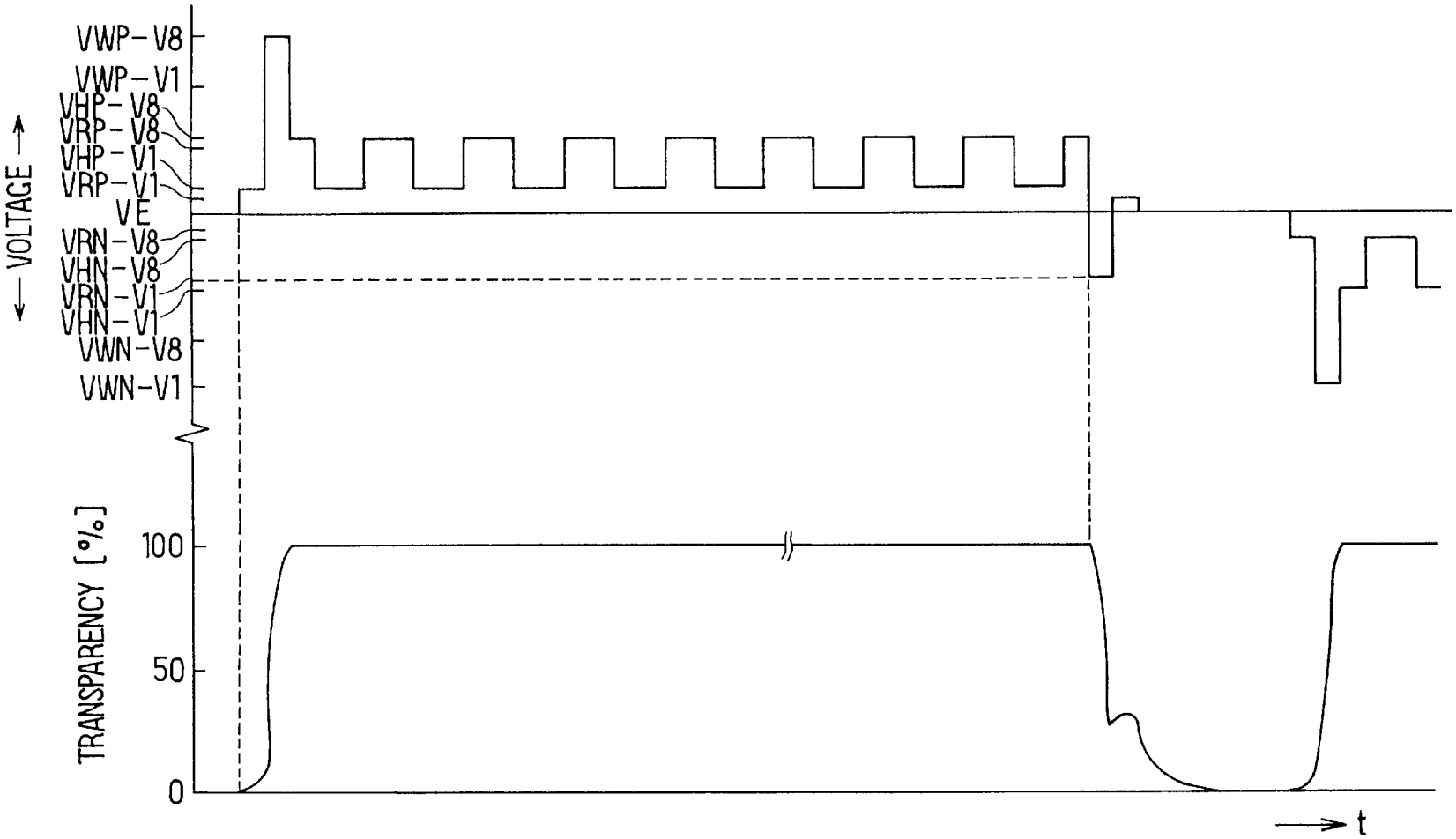
FIG. 22 is a timing chart showing a driving voltage applied to a pixel of the display panel and transparency of the anti-ferroelectric liquid crystal in the second embodiment.
Figure 23:
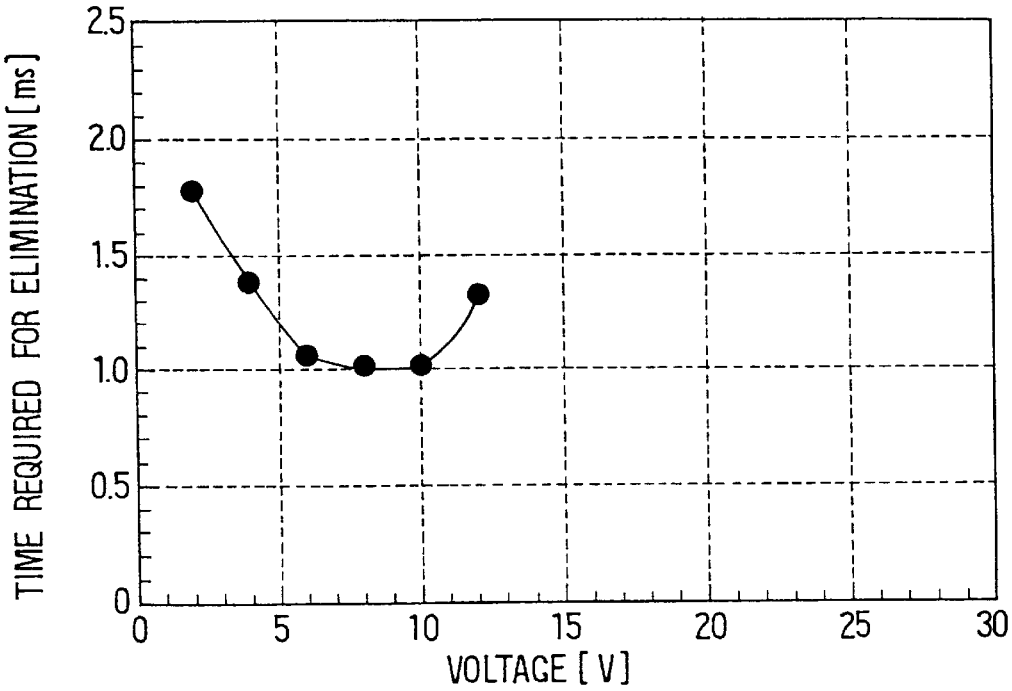
FIG. 23 is a graph showing relation between a voltage applied to the scanning electrode in an eliminating period and time required for elimination in the second embodiment.

Referring to FIGS. 19 to 23, a second embodiment of the present invention will be described. In this embodiment, no refresh pulse is applied at the beginning of the holding period, and the polarity of the holding voltage is not alternated as shown in FIGS. 19 and 20, as opposed to the first embodiment. In the eliminating period (RS− shown in FIG. 20) following the holding period, a bipolar pulse as labeled Q in FIG. 20 is applied to the scanning electrode. After the bipolar pulse voltage, voltage VE follows. The operation of the signal electrode driving circuit in this embodiment is shown in FIG. 21, which is similar to that of the first embodiment shown in FIG. 13. The driving voltages imposed on a pixel and the optical response thereto (transparency change) are shown in FIG. 22. As seen in FIG. 22, the transparency of the anti-ferroelectric liquid crystal decreases in an attenuating and vibrating manner in the eliminating period. The response time (time required for elimination) varies according to the level of the bipolar pulse voltage as shown in the graph of FIG. 23. The response time is about 1.0 ms in a range of the voltage from 6 to 10 V. This means that the anti-ferroelectric liquid crystal changes its states from the ferroelectric state to the anti-ferroelectric state in about a half of the response time in a conventional device, which is about 2.0 ms. Since the eliminating period of 1.0 ms in this embodiment is about 2% of the display period of one-frame (50 ms), no harmful flicker is visible on the display, and the brightness in a level of 98% of the theoretical maximum is attained. In addition, the state of the pixels is substantially uniform in a whole frame irrespective of the signal data even when the pixels are not completely in the anti-ferroelectric state in the eliminating period, because the bipolar pulse voltage is used in the eliminating period. Therefore, the cross-talk is sufficiently suppressed to the same degree as in the first embodiment.

Figure 24:
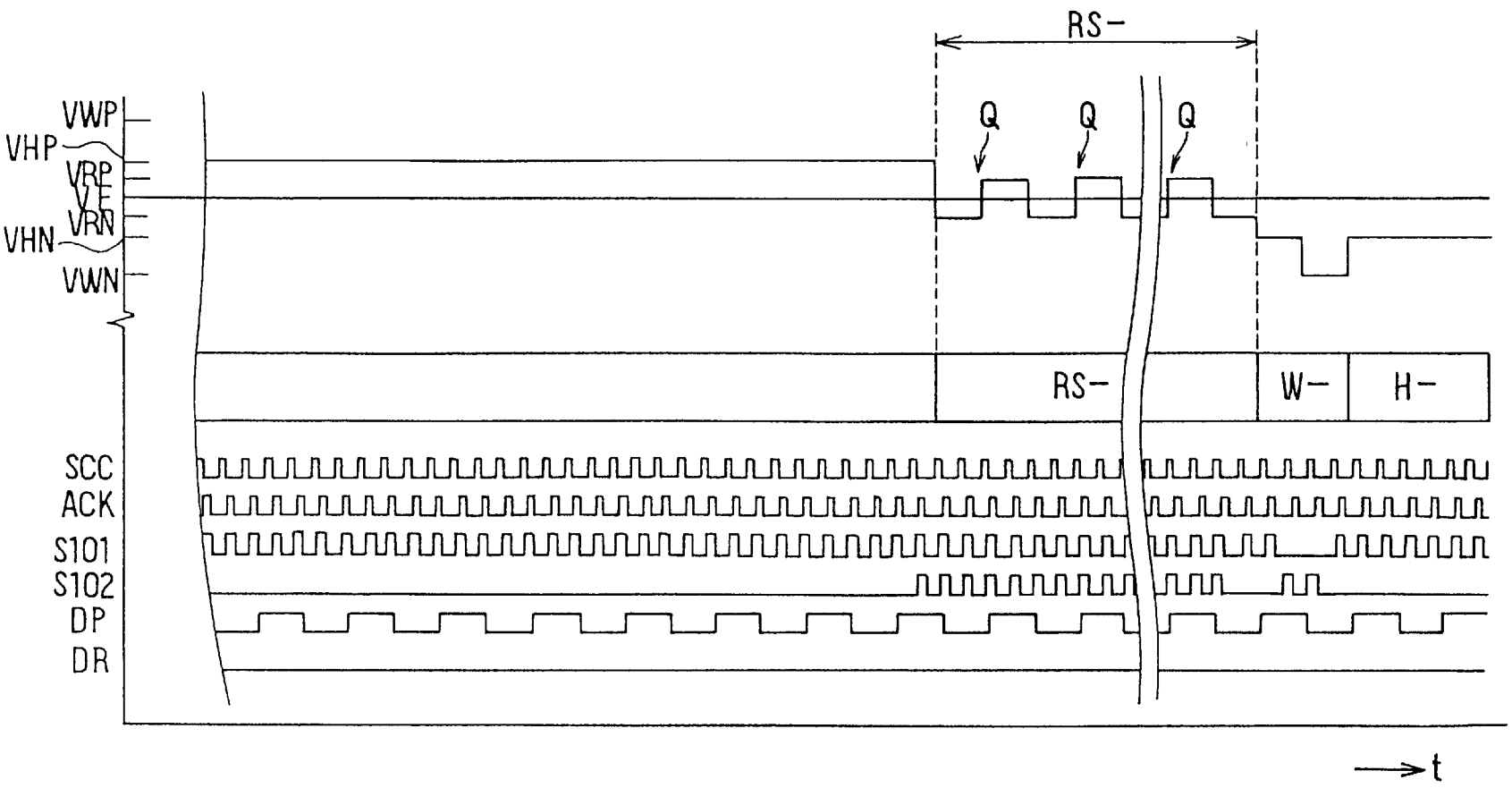
FIG. 24 is a timing chart showing operation of the scanning electrode driving circuit in a modification of the second embodiment.
Figure 25:
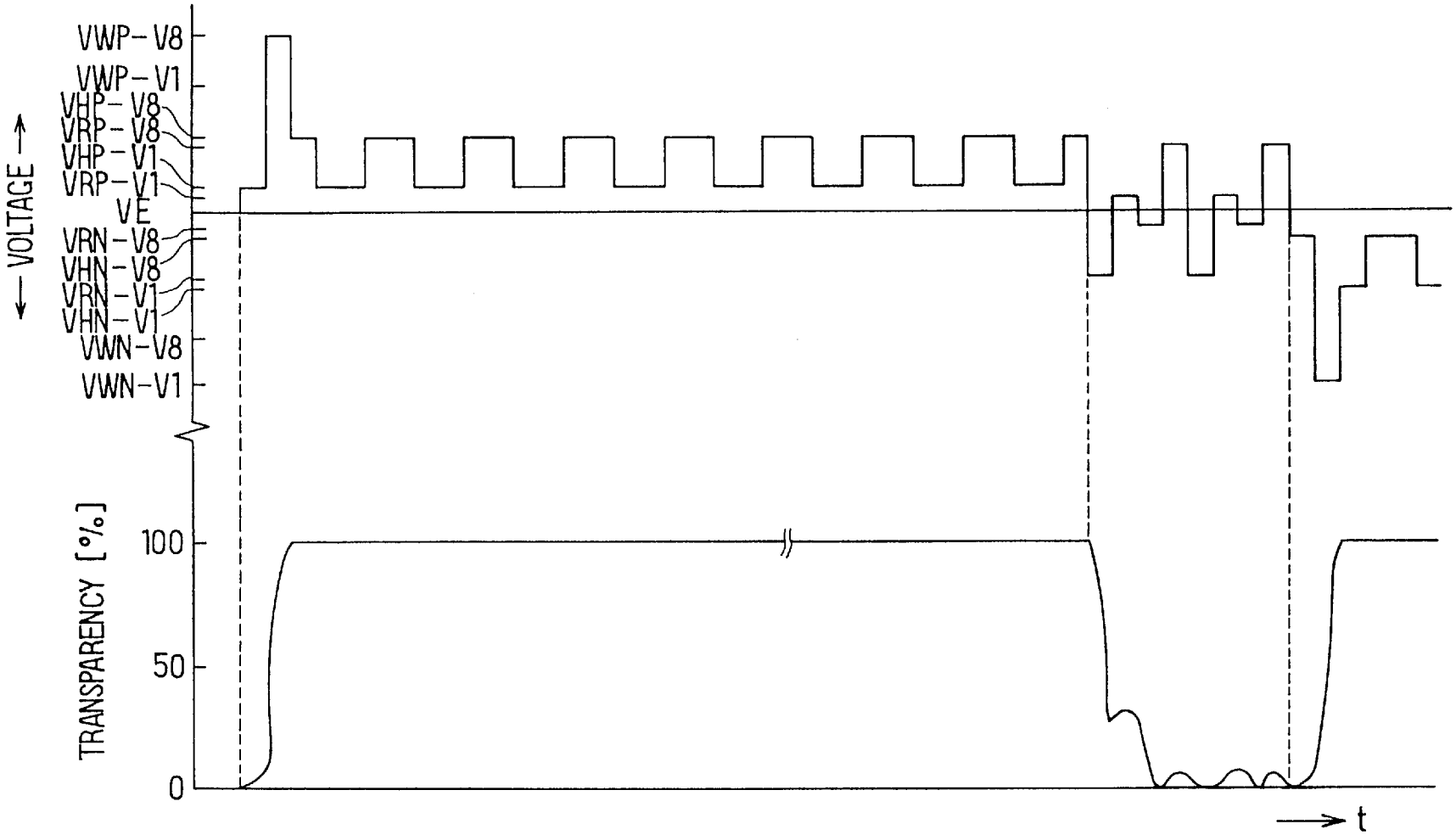
FIG. 25 is a timing chart showing a driving voltage applied to a pixel of the display panel and transparency of the anti-ferroelectric liquid crystal in the modification of the second embodiment.
Figure 26:
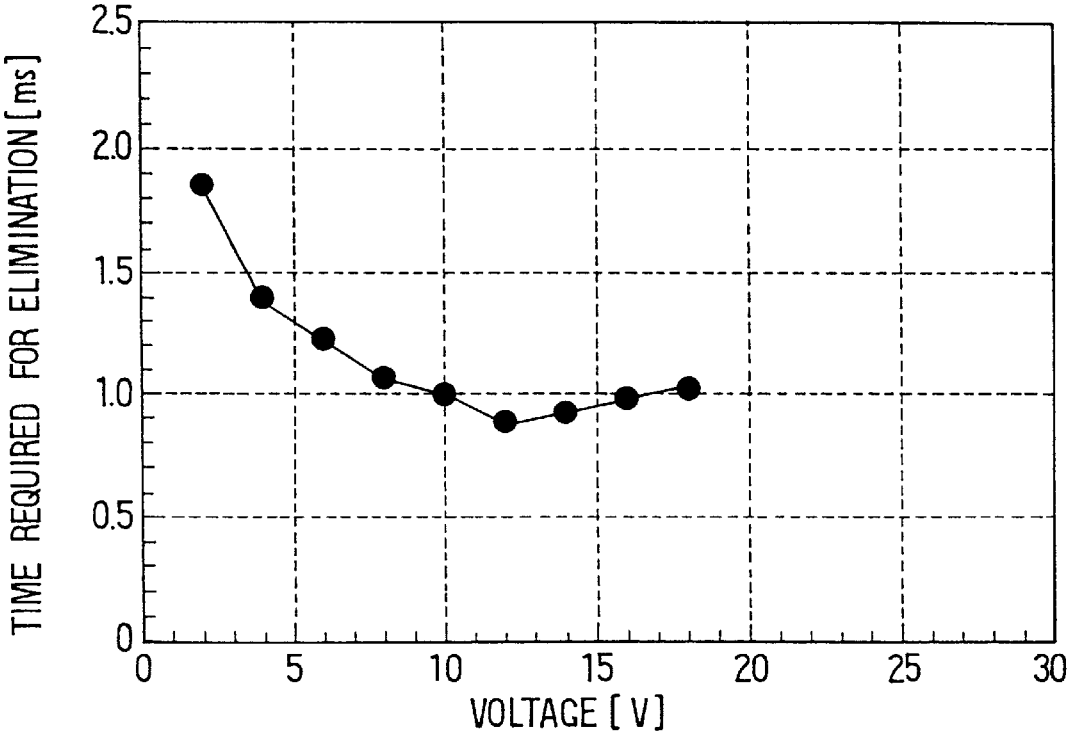
FIG. 26 is a graph showing relation between a voltage applied to the scanning electrode in an eliminating period and time required for elimination in the modification of the second embodiment.

FIGS. 24 to 26 show a modified form of the second embodiment. As shown in FIG. 24, a plurality of the bipolar pulse voltages are applied during the eliminating period (RS−), and the same level voltage as the holding voltage VHN is applied at the beginning of the selecting period (W−) which follows the eliminating period (RS−). The driving voltages imposed on a pixel and the transparency change of the anti-ferroelectric liquid crystal are shown in FIG. 25. The transparency decreases in the eliminating period in a vibratory manner. The response time (time required for elimination) of the anti-ferroelectric liquid crystal versus the level of the bipolar pulse voltage is shown in FIG. 26. It is seen in the graph that the response time is 1.0 ms or shorter in a range of the voltage from 10 to 18 V, which is about a half of that in a conventional device. Compared with the second embodiment, the response time is a little shorter and the voltage range attaining the response time of 1.0 ms is wider in this modification. Other advantages are the same as those of the second embodiment.

Though the anti-ferroelectric liquid crystal is used in all the embodiments described above, the liquid crystal is not limited thereto but other liquid crystals such as a smectic liquid crystal which is ferroelectric or a liquid crystal having characteristics similar to the anti-ferroelectric liquid crystal may be used.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A liquid crystal display device comprising:

a liquid crystal display panel having n×m pixels constituted by a matrix electrode structure having n stripes of scanning electrodes and m stripes of signal electrodes, and a liquid crystal disposed between the scanning electrodes and the signal electrodes, the liquid crystal being an anti-ferroelectric liquid crystal that changes states between an anti-ferroelectric state and a positive-or-negative ferroelectric state according to voltages imposed thereon;

scanning electrode driving means for imposing scanning voltages sequentially on the scanning electrodes, the means providing a selecting period during which picture images are written on the pixels, a holding period during which the picture images are maintained by a holding voltage, a polarity of which is reversed at least one time, and an eliminating period during which the picture images are eliminated by an eliminating voltage; and signal electrode driving means for imposing signal voltages representing the picture images sequentially on the signal electrodes in synchronism with the scanning voltages, thereby displaying picture images on the display panel, wherein:

the eliminating voltage includes a pulse voltage having a polarity opposite to a polarity of the holding voltage immediately preceding the eliminating period; and the eliminating voltage eliminates the picture images by changing the states of the anti-ferroelectric liquid crystal from the positive-or-negative ferroelectric state to the anti-ferroelectric state.

2. The liquid crystal display device as in claim 1, wherein:

a refresh pulse voltage which is higher than the holding voltage is imposed on the scanning electrodes when the polarity of the holding voltage is reversed in the holding period.

3. The liquid crystal display device as in claim 1 or 2, wherein:

a level and a width of the pulse voltage for eliminating the picture images are selected so that the picture images are eliminated in a shortest possible time.

4. The liquid crystal display device as in claim 1 or 2, wherein:

the pulse voltage for eliminating the picture images is deceased before an end of the eliminating period.

5. The liquid crystal display device as in claim 1 or 2, wherein:

the pulse voltage for eliminating the picture images is decreased to a standard level before an end of the eliminating period.

6. The liquid crystal display device as in claim 1 or 2, wherein:

a level of the pulse voltage for eliminating the picture images is the same as that of the holding voltage.

7. The liquid crystal display device as in claim 1 or 2, wherein:

a level of the pulse voltage for eliminating the picture images is the same as that of the selecting voltage.

8. The liquid crystal display device as in claim 1 or 2, wherein a width of the pulse voltage for eliminating the picture images is shorter than a response time of the anti-ferroelectric liquid crystal from the positive-or-negative ferroelectric state to the anti-ferroelectric state.

9. The liquid crystal display device as in claim 1 or 2, wherein:

the pulse voltage for eliminating the picture images is at least one bipolar pulse consisting of a first pulse having one polarity and a second pulse having an opposite polarity.

10. The liquid crystal display device as in claim 9, wherein:

the polarity of the first pulse of the bipolar pulse is opposite to the polarity of the holding voltage immediately preceding the eliminating period.

11. A liquid crystal display device comprising:

a liquid crystal display panel having n×m pixels constituted by a matrix electrode structure having n stripes of scanning electrodes and m stripes of signal electrodes, and a liquid crystal disposed between the scanning electrodes and the signal electrodes, the liquid crystal being an anti-ferroelectric liquid crystal that changes states between an anti-ferroelectric state and a positive-or-negative ferroelectric state according to voltages imposed thereon;

scanning electrode driving means for imposing scanning voltages sequentially on the scanning electrodes, the means providing a selecting period during which picture images are written on the pixels, a holding period during which the picture images are maintained by a holding voltage, a polarity of which is reversed at least one time, and an eliminating period during which the picture images are eliminated by an eliminating voltage; and signal electrode driving means for imposing signal voltages representing the picture images sequentially on the signal electrodes in synchronism with the scanning voltages, thereby displaying picture images on the display panel, wherein:

the eliminating voltage is a voltage which changes the states of the anti-ferroelectric liquid crystal from the positive-or-negative ferroelectric state to the anti-ferroelectric state and accelerates elimination of the picture images, so that the picture images are eliminated in a predetermined period of time.

12. The liquid crystal display device as in claim 9, wherein a level of the bipolar pulse is lower than a level of the holding voltage.

13. The liquid crystal display device as in claim 10, wherein:

the bipolar pulse is decreased to a standard level before an end of the eliminating period.

* * * * *